US005750302A

United States Patent [19]

Ogawa et al.

[11] Patent Number: 5,750,302

[45] Date of Patent: May 12, 1998

[54] MAGNETIC TONER FOR DEVELOPING ELECTROSTATIC IMAGE, IMAGE FORMING PROCESS, AND PROCESS CARTRIDGE

[75] Inventors: Yoshihiro Ogawa, Numazu; Koichi Tomiyama, Yokohama; Osamu Tamura, Kashiwa; Nobuyuki Okubo, Yokohama; Shunji Suzuki, Tokyo, all of Japan

[73] Assignee: Canon Kabushiki Kaisha, Tokyo, Japan

[21] Appl. No.: 822,650

[22] Filed: Mar. 24, 1997

[30] Foreign Application Priority Data

Mar. 22, 1996 [JP] Japan ..... 8-091851
Mar. 22, 1996 [JP] Japan ..... 8-091852

[51] Int. Cl.[6] ..... G03G 9/083; G03G 13/09; G03G 15/09

[52] U.S. Cl. ..... 430/106.6; 430/111; 430/122; 399/229

[58] Field of Search ..... 430/106.6, 111, 430/122, 903; 399/229

[56] References Cited

U.S. PATENT DOCUMENTS

| | | | |
|---|---|---|---|
| 2,297,691 | 10/1942 | Carlson | 430/31 |
| 4,206,064 | 6/1980 | Kiuchi et al. | 430/106 |
| 4,404,271 | 9/1983 | Kawagushi et al. | 430/110 |
| 4,883,736 | 11/1989 | Hoffend et al. | 430/110 |
| 4,921,771 | 5/1990 | Tomono et al. | 430/110 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,137,796 | 8/1992 | Takiguchi et al. | 430/106.6 |
| 5,307,122 | 4/1994 | Ohno et al. | 355/245 |
| 5,407,770 | 4/1995 | Tomita et al. | 430/106.6 |
| 5,424,810 | 6/1995 | Tomiyama et al. | 355/251 |
| 5,429,899 | 7/1995 | Chiba et al. | 430/106.6 |
| 5,578,408 | 11/1996 | Kohtaki et al. | 430/111 |

FOREIGN PATENT DOCUMENTS

| | | |
|---|---|---|
| 0124021 | 11/1984 | European Pat. Off. . |
| 42-23910 | 11/1967 | Japan . |
| 43-24748 | 10/1968 | Japan . |
| 45-26478 | 9/1970 | Japan . |
| 50-133338 | 10/1975 | Japan . |
| 52-3304 | 1/1977 | Japan . |
| 52-3305 | 1/1977 | Japan . |
| 54-99636 | 8/1979 | Japan . |
| 54-139544 | 10/1979 | Japan . |
| 55-42752 | 11/1980 | Japan . |
| 56-87051 | 7/1981 | Japan . |
| 56-104351 | 8/1981 | Japan . |
| 57-178257 | 11/1982 | Japan . |
| 57-52574 | 11/1982 | Japan . |
| 58-9153 | 1/1983 | Japan . |
| 58-40566 | 3/1983 | Japan . |
| 58-139156 | 8/1983 | Japan . |
| 58-150975 | 9/1983 | Japan . |
| 58-41508 | 9/1983 | Japan . |
| 59-7385 | 2/1984 | Japan . |
| 60-170864 | 9/1985 | Japan . |
| 61-138259 | 6/1986 | Japan . |
| 63-113558 | 5/1988 | Japan . |
| 63-188158 | 8/1988 | Japan . |
| 1-112253 | 4/1989 | Japan . |
| 2-284158 | 11/1990 | Japan . |
| 3-247514 | 11/1991 | Japan . |
| 5-72801 | 3/1993 | Japan . |

*Primary Examiner*—Roland Martin
*Attorney, Agent, or Firm*—Fitzpatrick, Cella, Harper & Scinto

[57] ABSTRACT

A magnetic toner for developing an electrostatic image has magnetic toner particles containing at least a binder resin and magnetic iron oxide particles. The magnetic iron oxide particles have been surface-treated with an aliphatic alcohol having carbon atoms of from 12 to 300 on the average. The magnetic toner has a weight average particle diameter of 13.5 μm or smaller, and contains magnetic toner particles with particle diameters of 3.17 μm or smaller in an amount not less than 1% by number as number-based percentage determined from number distribution.

86 Claims, 4 Drawing Sheets

MAGNETIC TONER FOR DEVELOPING ELECTROSTATIC IMAGE, IMAGE FORMING PROCESS, AND PROCESS CARTRIDGE

BACKGROUND OF THE INVENTION

1. Field of the Invention

This invention relates to a magnetic toner for developing an electrostatic image in image forming processes such as electrophotography and electrostatic printing, and also relates to an image forming process and a process cartridge which employ such a magnetic toner.

2. Related Background Art

A number of methods are hitherto known for electrophotography, as disclosed in U.S. Pat. No. 2,297,691, Japanese Patent Publication No. 42-23910 and No. 42-4748. In general, copies are obtained by forming an electrostatic latent image on a photosensitive member by utilizing a photoconductive material and by various means, subsequently developing the latent image by the use of a toner to form a toner image as a visible image, transferring the toner image to a transfer medium such as paper if necessary, and then fixing to the transfer medium the toner image by heat and pressure. Toner having not been transferred to remain on the photosensitive member is removed by various cleaning means, and the above steps are repeated.

In recent years, machinery making use of electrophotography is not only used to merely take copies of an original but also has began to be used in digital printers as output means of computers or for the copying of highly detailed images such as graphic designs.

With progress of computer networking in and around offices, the consumption of electric power necessary for driving computers and computer peripheral equipment is increasing. It is sought to develop low-power driving machinery that can solve such a problem.

When used as printers, they are used in such a condition that copies are taken three to five times the copies taken by copying machines of the like grade, and are at the same time required to ensure a high running performance and a high image quality stability in development.

Hence, they are more severely sought to achieve a higher reliability, where the performances required accordingly have become higher, and more advanced machines can no longer be made up unless improvements of performances can be achieved in respect of image forming processes, inclusive of toners, and means for enabling lower electric power consumption.

Now, one of the performances required for toners to achieve a high image quality and a high minuteness is the development performance.

As development systems, one-component development systems and two-component development systems are available. In either development system, the friction between a triboelectric charging member or material such as a sleeve or a carrier and a toner must be well made in order to improve the development performance of toner. For such purpose, it is essential to improve charging performance and fluidity of the toner without contamination of the triboelectric charging member and other members by toner.

In recent years, the machinery making use of electrophotography includes conventional copying machines and, in addition thereto, printers and facsimile machines, providing a variety. Especially in the case of printers and facsimile machines, the part of copying assemblies must be made smaller, and hence one-component developing apparatus making use of one-component developers are mostly used.

One-component development systems require no carrier particles such as glass beads or iron powder required in two-component development systems, and hence can make developing assemblies themselves small-sized and light-weight. Moreover, since in the two-component development systems the concentration of toner in the two-component developer must be kept constant, a device for detecting toner concentration so as to supply the toner in the desired quantity is required, resulting in an increase in size and weight of the developing assemblies. In the one-component development system, such a device is not required, and hence the developing assemblies can be made small and light-weight as being preferable.

In particular, a process making use of a magnetic one-component developer is advantageous which is comprised of toner particles having magnetic properties.

As a charging means in such electrophotography, a means has been used which utilizes corona discharge, what is called corotron or scorotron. Since ozone is generated in a large quantity when the corona discharge takes place, in particular, a negative corona is formed, electrophotographic apparatus are required to be provided with filters for collecting ozone, bringing about the problems that the apparatus must be made larger and the running cost increases. As a technique for solving such problems, a charging method has been brought out in which a charging member such as a roller or a blade is brought into contact with the surface of a photosensitive member to electrostatically charge the photosensitive member (hereinafter "contact charging"). This contact charging method is a charging method in which a narrow space is formed in the vicinity of the part where the charging member comes into contact with the photosensitive member and a discharge is formed that can be explained by what is called the Paschen law. This contact charging method is a known technique as disclosed in, e.g., Japanese Patent Application Laid-open No. 57-178257, No. 56-104351, No. 58-40566, No. 58-139156 and No. 58-150975.

In printers, LED printers or LBP printers are prevailing in the recent market. As a trend of techniques, there is a tendency toward higher resolution. That is, those which formerly have a resolution of 240 or 300 dpi are being replaced by those having a resolution of 400, 600 or 800 dpi. Accordingly, with such a high resolution, the developing systems are now required to have development performance with a higher minuteness. Copying machines have also made progress to have higher functions, and hence they trend toward digital systems. In such digital image forming systems, chiefly employed is a method in which electrostatic latent images are formed by using a laser. Hence, the copying machines also trend toward a high resolution and, like the printers, it has been sought to provide a developing system with high resolution and high minuteness. Accordingly, toners having small particle diameters are proposed in Japanese Patent Application Laid-open No. 1-112253 and No. 2-284158.

However, while on the one hand it becomes possible to out put images with high resolution and high minuteness by making toners made to have small particle diameters, magnetic toners on the other hand tend to cause the problems as stated below.

Magnetic toners commonly contain a magnetic iron oxide as a magnetic material. The magnetic iron oxide is, e.g., melt-kneaded with toner materials such as binder resin and is thereby dispersed in magnetic toner particles. It, however, is difficult to bring an inorganic matter such as the magnetic iron oxide into firm adhesion to the organic matter binder resin.

On the surfaces of toner particles, magnetic iron oxide laid bare to the surfaces is present, and the magnetic iron oxide tends to come off from the toner particle surfaces when the surface of magnetic iron oxide has a weak adhesion to the binder resin, so that magnetic iron oxide standing free increases. The magnetic iron oxide standing free has a very smaller particle diameter than the toner particles and has a strong adhesion, and hence it tends to remain on the photosensitive member in the step of transfer without being transferred to the transfer medium. The magnetic iron oxide having remained on the photosensitive member may adhere to and contaminate the contact charging member at the part where the contact charging member comes into contact with the photosensitive member, to cause faulty charging. Moreover, making the toner particles have smaller particle diameters results in an increase in the surface area of the toner particles, and hence the magnetic iron oxide standing free more tends to be formed.

As disclosed in Japanese Patent Application Laid-open No. 54-99636, No. 54-139544, No. 58-9153 and No. 3-247514, it is proposed to subject magnetic powder to surface treatment. However, a more improvement is necessary to prevent contamination of the contact charging member.

In the case when toner particles are made to have small particle diameters, the developer may have a poor fluidity to tend to cause a phenomenon in which toner adheres to non-image areas, called "fogging", as known in the art.

For example, in Japanese Patent Application Laid-open No. 5-72801, it is proposed to use a magnetic iron oxide characterized by the manner of distribution of a silicon compound.

Now, among performances required for toners in the digital printers and the copying of highly detailed images, the most important is the fixing performance.

With regard to the fixing step, various methods and assemblies are brought out. At present, a method most commonly used is a pressure heating system employing a heat roller.

The pressure heating system employing a heat roller is a method in which a sheet to which toner images are to be fixed (a recording medium) is passed on a heat roller whose surface is formed of a material having a releasability to the toner while bringing the toner image side of the former into contact with the surface of the latter under application of a pressure to fix the toner images. In this method, since the surface of the heat roller comes into contact with the toner images of the recording medium under application of a pressure, the toner images can be made to melt-adhere to the recording medium at a very good thermal efficiency and can be quickly fixed, thus the method is very useful for high-speed electrophotographic copying machines. However, since in the above method the surface of the heat roller (fixing roller) comes into contact with the toner images in a molten state under application of a pressure, part of the toner images may adhere and transfer to the surface of the fixing roller to contaminate the subsequent recording medium (an offset phenomenon). It is considered as one of essential conditions in the heat-roller fixing system to make toner not adhere to the surface of the heat fixing roller.

Recently, in place of the heat roller, a fixing assembly comprising a heating element and, provided opposingly thereto under pressure contact, a pressing member with which a recording medium is brought into close contact via a film has been put into practical use, and is advantageous also in view of thermal efficiency. Since, however, the toner surface is melted, the offset more tends to occur, and is more sought to be prevented.

Japanese Patent Application Laid-open No. 52-3304, No. 52-3305, No. 57-52574, No. 61-138259, No. 56-87051, No. 63-188158 and No. 63-113558 disclose techniques in which waxes are incorporated into toners.

Such waxes can be uniformly dispersed in toners with difficulty, and any wax having become liberated or localized tends to adversely affect developing performance and so forth after repeated use. In addition, because of a plastic effect of wax, the toner may have a low elasticity and may have a low strength to bring about a possibility that the photosensitive member and developing members are contaminated with toner, and may be seriously contaminated with toner especially in the development system employing the contact charging as charging means. Thus, there is room for further improvement.

In order to stabilize the charging performance of toners, dyes or pigments called charge control agents are commonly used.

Japanese Patent Application Laid-open No. 60-170864 discloses that, among metal complex compounds, those having a good compatibility with binder resins show uniform negative chargeability and enable formation of sharp copied images, but may cause faulty cleaning to cause incomplete wipe-off of toner or filming on the photosensitive member, and hence those insoluble in binder resins are preferable and are good for the prevention of filming.

However, toners employing the metal complex compounds insoluble in binder resins have insufficient dispersibility in the binder resins. Hence, when toners are made to have fine particles while using such metal complex compounds insoluble in binder resins, the charging may become excess especially in an environment of low humidity to cause fogging and density fall.

Thus, improvements in the performances of toners are still unsatisfactory, and there are many points for further improvements.

SUMMARY OF THE INVENTION

An object of the present invention is to provide a magnetic toner for developing an electrostatic image and an image forming process that have solved the above problems unsettled in the prior art.

Another object of the present invention is to provide a magnetic toner for developing an electrostatic image, that may cause no contamination of charging members, and an image forming process and a process cartridge which employ such a magnetic toner.

Still another object of the present invention is to provide a magnetic toner for developing an electrostatic image, having a superior fluidity, promising a high image density and being fee from fogging, and an image forming process and a process cartridge which employ such a magnetic toner.

A further object of the present invention is to provide a magnetic toner for developing an electrostatic image, that enables output of images having high resolution and high minuteness, and an image forming process and a process cartridge which employ such a magnetic toner.

A still further object of the present invention is to provide a magnetic toner for developing an electrostatic image, having high performances in respect of fixing and anti-offset, and an image forming process and a process cartridge which employ such a magnetic toner.

A still further object of the present invention is to provide a magnetic toner for developing an electrostatic image, that does not adversely affect charging members, developer carrying members, developer control members and electrostatic image bearing members, and an image forming process and a process cartridge which employ such a magnetic toner.

A still further object of the present invention is to provide a magnetic toner for developing an electrostatic image, promising a high image density in every environment, and an image forming process and a process cartridge which employ such a magnetic toner.

To achieve the above objects, the present invention provides a magnetic toner for developing an electrostatic image, comprising magnetic toner particles containing at least a binder resin and magnetic iron oxide particles, wherein;

the magnetic iron oxide particles have been surface-treated with an aliphatic alcohol having carbon atoms of from 12 to 300 on the average; and the magnetic toner has a weight average particle diameter of 13.5 μm or smaller, and contains magnetic toner particles with particle diameters of 3.17 μm or smaller in an amount not less than 1% by number as number-based percentage determined from number distribution.

The present invention also provides an image forming process comprising the steps of;

bringing a charging member to which a voltage is externally applied, into contact with a latent image bearing member to electrostatically charge the latent image bearing member (a charging step);

forming an electrostatic latent image on the latent image bearing member thus charged, by an electrostatic latent image forming means (an electrostatic latent image forming step); and developing the electrostatic latent image formed on the latent image bearing member, by the use of a magnetic toner held by a developing means, to form a toner image (a developing step);

wherein;

the magnetic toner comprises magnetic toner particles containing at least a binder resin and magnetic iron oxide particles;

the magnetic iron oxide particles have been surface-treated with an aliphatic alcohol having carbon atoms of from 12 to 300 on the average; and the magnetic toner has a weight average particle diameter of 13.5 μm or smaller, and contains magnetic toner particles with particle diameters of 3.17 μm or smaller in an amount not less than 1% by number as number-based percentage determined from number distribution.

The present invention still also provides a process cartridge detachably mountable to a main assembly of an image forming apparatus, comprising;

a latent image bearing member for holding thereon an electrostatic latent image;

a charging member provided in contact with the latent image bearing member, for electrostatically charging the latent image bearing member by externally applying a voltage; and a developing means holding a magnetic toner for developing the electrostatic latent image held on the latent image bearing member, to form a toner image;

wherein;

the magnetic toner comprises magnetic toner particles containing at least a binder resin and magnetic iron oxide particles;

the magnetic iron oxide particles have been surface-treated with an aliphatic alcohol having carbon atoms of from 12 to 300 on the average; and the magnetic toner has a weight average particle diameter of 13.5 μm or smaller, and contains magnetic toner particles with particle diameters of 3.17 μm or smaller in an amount not less than 1% by number as number-based percentage determined from number distribution.

DESCRIPTION OF THE PREFERRED EMBODIMENTS

Figure 1:
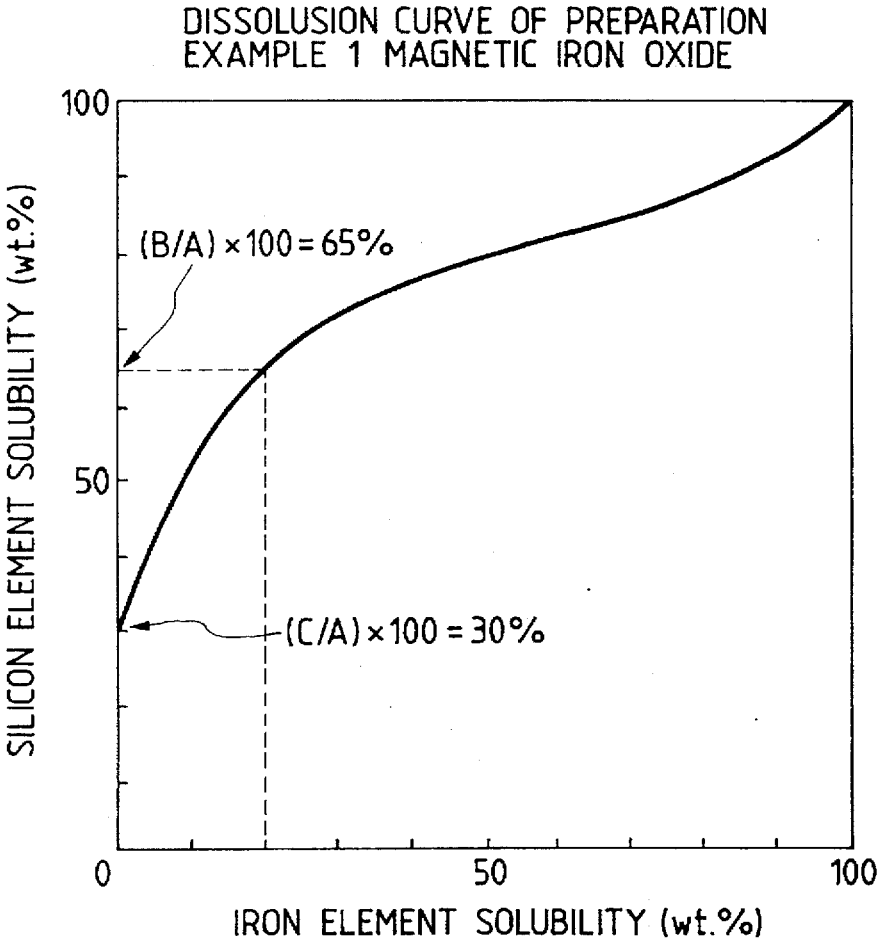
FIG. 1 shows a dissolution curve of a magnetic iron oxide.

In the magnetic toner of the present invention, the surfaces of magnetic iron oxide particles are treated with a specific aliphatic alcohol having a good affinity for binder resin. This brings about an improvement in adhesion between the magnetic iron oxide particles and the binder resin to make magnetic iron oxide particles less come off and less become liberated from toner particle surfaces. As the result, the contact charging member can be prevented from being contaminated by the magnetic iron oxide particles standing liberated.

When the magnetic toner has a weight average particle diameter larger than 13.5 μm or contains magnetic toner particles with particle diameters of 3.17 μm or smaller in an amount less than 1% by number as number-based percentage determined from number distribution, it is difficult to form images with high resolution and high minuteness but, because of a small specific surface area of the toner particles, the magnetic iron oxide particles may less come off from the toner particle surfaces and hence may less contaminate the contact charging member even when magnetic iron oxide particles commonly used in the past are used. Namely, the magnetic iron oxide particles surface-treated with an aliphatic alcohol as used in the present invention is more effective when used in a magnetic toner having a weight average particle diameter of 13.5 μm or smaller and containing magnetic toner particles with particle diameters of 3.17 μm or smaller in an amount not less than 1% by number as number-based percentage determined from number distribution, which can form images with high resolution and high minuteness.

The aliphatic alcohol used in the present invention may have carbon atoms of from 12 to 300 on the average, preferably from 12 to 100, and more preferably from 20 to 100. An aliphatic alcohol having carbon atoms less than 12 on the average has a low boiling point to tend to evaporate at the time of heating, e.g., during melt-kneading, making it difficult to obtain a satisfactory effect. An aliphatic alcohol having carbon atoms more than 300 on the average may have a low affinity for he binder resin and can be less effective for the improvement in adhesion between the binder resin and the magnetic iron oxide particles, making it impossible to well effectively lessen the magnetic iron oxide particles standing liberated.

The aliphatic alcohol used in the surface treatment of the magnetic iron oxide particles may contain impurities or other substances so long as the effect of surface treatment is not damaged, and may be either an unsaturated alcohol or a polyhydric alcohol. In the surface treatment, the aliphatic alcohol may preferably be used in an amount of from 0.05 to 15 parts by weight, and more preferably from 0.5 to 10 parts by weight, based on 100 parts by weight of the magnetic iron oxide.

If the aliphatic alcohol is used in the surface treatment in an amount less than 0.05 part by weight, the adhesion between the magnetic iron oxide particles and the binder resin may be insufficient and the magnetic iron oxide particles standing liberated may be present in a large quantity to tend to contaminate the contact charging member. If in an amount more than 15 parts by weight, the treated particles may have such a form that the magnetic iron oxide is present in the aliphatic alcohol, resulting in an insufficient dispersion of the magnetic iron oxide in the toner.

Figure 2:
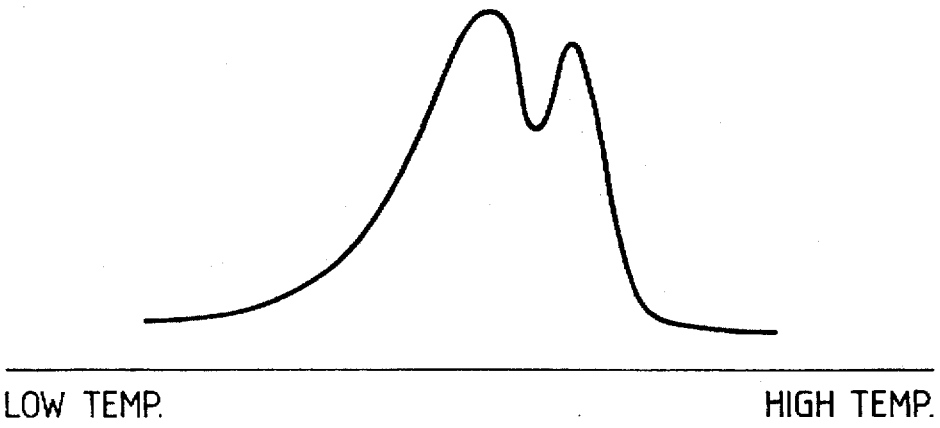
FIG. 2 shows a DSC chart endothermic curve of magnetic iron oxide particles treated with wax as used in Examples, and diagrammatically illustrates an instance where the wax has two peak values.

In the present invention, the aliphatic alcohol having carbon atoms of from 12 to 300 on the average, used to treat the surfaces of the magnetic iron oxide particles, may also be obtained by, e.g., (i) controlling synthesis conditions when the aliphatic alcohol is synthesized, (ii) blending two or more different aliphatic alcohols having different average numbers of carbon atoms or (iii) blending the aliphatic alcohol having carbon atoms of from 12 to 300 on the average with an additional wax so that it can be used in the form of a wax having, as shown in FIG. 2, at least two peak values in a DSC chart endothermic curve in the region of temperatures of from 60° C. to 150° C. This is preferable because the dispersibility of the surface-treated magnetic iron oxide particles in the magnetic toner particles can be improved.

More specifically, when the magnetic iron oxide particles are coated with the wax having at least two peak values in a DSC chart endothermic curve in the region of from 60° C. to 150° C., the wax appropriately adheres to the surfaces of the magnetic iron oxide particles, so that it may much less come off from their surfaces when premixed with other toner constituent materials such as the binder resin. Since the wax is present in the vicinity of the surfaces of the magnetic iron oxide particles during the melt-kneading step, it slowly melts on, smoothly extends over, and permeates the surfaces of the magnetic iron oxide particles. As the result, the surfaces of the magnetic iron oxide particles can be much better coated with the wax. The coatings thus formed have an affinity for other toner constituent materials, and hence the magnetic iron oxide particles treated with the wax can have a more improved dispersibility and can have a higher adhesion to other toner constituent materials, as so presumed.

The additional wax blended with the aliphatic alcohol having carbon atoms of from 12 to 300 on the average, so as to be used in the form of the wax having at least two peak values in a DSC chart endothermic curve in the region of from 60° C. to 150° C., may include polyethylene and polyethylene derivatives. The polyethylene derivatives may include polyethylene having a polar group such as a hydroxyl group, a carboxyl group, an alkyl ether group, an ester group or a sulfonyl group.

As the proportion of the aliphatic alcohol having carbon atoms of from 12 to 300 on the average contained in the wax having two peak values, the former may preferably be contained in an amount of from 50 to 100% by weight, and more preferably from 60 to 100% by weight, based on the weight of the latter.

If in the wax having two peak values the aliphatic alcohol having carbon atoms of from 12 to 300 on the average is contained in an amount less than 20% by weight, the magnetic iron oxide may be insufficiently dispersed in the binder resin.

In the case when the magnetic iron oxide particles are surface-treated with the wax in the form of the one having two peak values, the wax having two peak values may preferably be used in the treatment in an amount of from 0.2 to 15 parts by weight, and more preferably from 0.5 to 10 parts by weight, based on 100 parts by weight of the magnetic iron oxide particles.

If the wax having two peak values is used in the treatment in an amount less than 0.2 part by weight, the coating of the magnetic iron oxide particle surfaces may be less effective, and if in an amount more than 15 parts by weight, the magnetic iron oxide particles may have so an excessively large coat thickness that the coated magnetic iron oxide particles may agglomerate one another, forming masses in some cases, and hence the magnetic iron oxide particles may have a poor dispersibility to adversely affect the images to be formed.

In the present invention, the surface treatment of the magnetic iron oxide particles with the aliphatic alcohol is meant to provide a state in which the aliphatic alcohol is present on the surfaces of the magnetic iron oxide particles irrespective of whether it is in a solid form or a liquid form. The surface treatment may be made using a method commonly available. For example, the magnetic iron oxide particles and the aliphatic alcohol in a necessary quantity may be put into a Henschel mixer or a muller mixer and mixed therein. In this instance, these may be optionally heated.

In the present invention, the endothermic curve of the DSC chart is obtained using a differential thermal analyzer (DSC measuring device, DSC-7, manufactured by Perkin Elmer Co.).

A sample for measurement is precisely weighed in an amount of from 5 to 20 mg, and preferably 10 mg. This sample is put in a pan made of aluminum and an empty aluminum pan is set as reference. Measurement is made in an ordinary humidity environment at a rate of temperature rise of 10° C./min within the measuring temperature range of from 30° C. to 200° C. In the course of this temperature rise, main-peak endothermic peaks in the temperature range of from 60° C. to 150° C. are obtained. The peaks that can be recognized here are counted to determine the peak values.

The magnetic iron oxide particles used in the present invention may preferably contain silicon element. Also, magnetic iron oxide particles on the surfaces of which the silicon element is present are preferred.

The magnetic iron oxide particles used in the present invention may more preferably be those having the silicon element in a total content A of from 0.5 to 4% by weight based on the weight of iron element, and in which the ratio of content B of the silicon element present when the magnetic iron oxide particles have an iron element dissolution of up to 20% by weight to total content A of the silicon element of the magnetic iron oxide particles, (B/A)×100, is from 44 to 85% and the ratio of content C of the silicon element present on the surfaces of the magnetic iron oxide particles to total content A of the silicon element of the magnetic iron oxide particles, (C/A)×100, is from 10 to 55%.

If the total content A of silicon is smaller than 0.5% by weight, the fluidity of the magnetic toner may be less effectively improved to cause an increase in fogging, undesirably. If it is larger than 4% by weight, the silicon may excessively remain on the surfaces of the magnetic iron oxide particles to tend to cause a problem in environmental stability and cause a decrease in image density.

If (B/A)×100 is less than 44%, i.e., if the silicon element is present in the core portions in a large quantity, not only the production efficiency tends to become poor but also the magnetic iron oxide particles may have unstable magnetic characteristics. If (B/A)×100 is more than 84%, i.e., if the silicon element is present in the surface layer portions of the magnetic iron oxide particles in a too large quantity, the silicon element is present in a large quantity in layers at the surfaces of the magnetic iron oxide particles, so that their surfaces may be brittle to mechanical impact to tend to cause many difficulties when used in the magnetic toner.

If (C/A)×100 is smaller than 10%, the surfaces of the magnetic iron oxide particles have the silicon element in so small a quantity that a good fluidity can be obtained with difficulty. If (C/A)×100 is larger than 55%, the surfaces of the magnetic iron oxide particles are so much irregular that the irregular portions of the surfaces of the magnetic iron oxide particles may become fragments to disperse in toner particles to tend to adversely affect the developing performance.

Namely, in order to obtain good properties of the magnetic toner, the silicon element present in the magnetic iron oxide particles as described above may preferably be distributed in such a way that it continuously or stepwise increases from insides toward surfaces.

The magnetic iron oxide particles having the silicon element according to the present invention can be produced, e.g., in the following manner.

A stated amount of a silicic acid compound is added to an aqueous ferrous salt solution, followed by addition of an equivalent weight or more of an alkali such as sodium hydroxide to prepare an aqueous solution containing ferrous hydroxide. Into the aqueous solution thus prepared, air is blown while maintaining its pH to 7 or more (preferably pH 8 to 10), and the ferrous hydroxide is subjected to oxidation reaction while heating the aqueous solution at 70° C. or above, to firstly form seed crystals serving as cores of the magnetic iron oxide particles.

Next, an aqueous solution containing ferrous sulfate in an amount of about one equivalent weight based on the weight of the alkali previously added is added to a slurry containing the seed crystals. The reaction of the ferrous hydroxide is allowed to proceed while maintaining the slurry to pH 6 to 10 and while blowing air into it, to make magnetic iron oxide particles grow around the seed crystals as cores. With progress of the oxidation reaction, the pH of the slurry shifts to the acid side, where it is preferable not to make the pH of the slurry less than 6. At the termination of the oxidation reaction, the pH of the slurry may preferably be adjusted to thereby localize the silicic acid compound in a stated quantity to the surface layers and surfaces of the magnetic iron oxide particles.

The silicic acid compound may be exemplified by silicates such as commercially available sodium silicate, and silicic acids such as sol-like silicic acid produced by hydrolysis. Other additives such as aluminum sulfate and aluminum oxide may also be added so long as they do not adversely affect the present invention.

As the ferrous salt, it is commonly possible to use iron sulfate formed as a by-product in the production of titanium sulfate, or iron sulfate formed as a by-product when the surfaces of steel sheets are washed. It is also possible to use iron chloride.

When magnetic iron oxide is produced by the aqueous solution method, an iron concentration of from 0.5 to 2 mol/l. is commonly employed in order to prevent the viscosity from increasing at the time of reaction and taking account of the solubility of iron sulfate. In general, the lower the concentration of iron sulfate is, the finer the particle size of products tends to be. During the reaction, the larger the amount of air is and the lower the reaction temperature is, the finer particles tend to be formed.

The magnetic iron oxide particles having the silicic acid component may preferably be produced by the method described above and the resulting magnetic iron oxide particles may be used in the magnetic toner.

In the present invention, the content C of silicon element on the surfaces of the magnetic iron oxide particles can be determined by the method as described below. For example, about 3 liters of deionized water is put into a 5 liter beaker, which is then heated with a water bath so as to have a liquid temperature of from 50° C. to 60° C. About 25 g of magnetic iron oxide formed into a slurry using about 400 ml of deionized water is added to the 5 liter beaker while being washed with about 300 ml of deionized water, which is added together with the deionized water.

Subsequently, highest-grade sodium hydroxide is added while keeping temperature at about 60° C. and stirring speed at about 200 rpm, to form an about 1N sodium hydroxide solution, where the concentration of magnetic iron oxide is controlled to be about 5 g/l. The silicon compound such as silicic acid on the surfaces of the magnetic iron oxide particles is started to dissolve. After 30 minutes from the start of dissolution, 20 ml of the solution is sampled, and is filtered with a 0.1 μm membrane filter to collect a filtrate. The filtrate is subjected to inductively coupled plasma spectrometry (ICP) to quantitatively determine the silicon element.

The content C of silicon element corresponds to silicon element concentration (mg/l) per unit weight of magnetic iron oxide (5 g/l of magnetic iron oxide) in the aqueous sodium hydroxide solution.

In the present invention, the content (%) of silicon element (based on iron element) of the magnetic iron oxide particles, the solubility of iron element and the content A and B of silicon element can be determined by the method as described below. For example, about 3 liters of deionized water is put into a 5 liter beaker, which is then heated with a water bath so as to have a liquid temperature of from 45° C. to 50° C. About 25 g of magnetic iron oxide formed into a slurry using about 400 ml of deionized water is added to the 5 liter beaker while being washed with about 300 ml of deionized water, which is added together with the deionized water.

Subsequently, highest-grade hydrochloric acid is added while keeping temperature at about 50° C. and stirring speed at about 200 rpm, where the dissolution is started. At this stage, the concentration of magnetic iron oxide is about 5 g/l, and about 3N aqueous hydrochloric acid solution is formed. About 20 ml of the solution is sampled several times after the start of dissolution and until the solution becomes transparent upon complete dissolution, and the solutions thus sampled are filtered with 0.1 μm membrane filters to collect filtrates. The filtrates are subjected to inductively coupled plasma spectrometry (ICP) to quantitatively determine the iron element and the silicon element.

The iron element solubility for each sample is calculated according to the following expression.

$$\text{Iron element solubility (\%)} = \frac{\text{Iron element concentration in sample (mg/l)}}{\text{Iron element concentration when dissolved completely (mg/l)}} \times 100$$

The silicon element content (%) for each sample is calculated according to the following expression.

$$\text{Silicon element content (\%)} = \frac{\text{Silicon element concentration (mg/l)}}{\text{Iron element concentration (mg/l)}} \times 100$$

The total content A of silicon element of the magnetic iron oxide corresponds to silicon element concentration (mg/l) per unit weight of magnetic iron oxide (5 g/l of magnetic iron oxide) after dissolved completely.

The content B of silicon element of the magnetic iron oxide corresponds to silicon element concentration (mg/l) per unit weight of magnetic iron oxide (5 g/l of magnetic iron oxide) to be detected in the case of magnetic iron oxide solubility of 20%.

The content A, B and C can be measured by a method including;

(1) a method in which the sample of magnetic iron oxide is divided into two portions, where the content (%) of silicon element and the content A and B are measured on the one portion and the content C is measured on the other portion; and (2) a method in which the content C of magnetic iron oxide in the sample is measured and, using the sample having been used for measurement, content B' (content obtained by subtracting the content C from the content B) and content A' (content obtained by subtracting the content C from the content A) are measured to finally calculate the content A and B.

The magnetic iron oxide particles used in the present invention may preferably have a number average particle diameter of from 0.05 to 0.40 μm, more preferably from 0.10 to 0.40 μm, and still more preferably from 0.10 to 0.30 μm.

If the magnetic iron oxide particles have a number average particle diameter smaller than 0.05 μm, the magnetic iron oxide may have a high cohesiveness to make the dispersion in binder resin insufficient. If larger than 0.40 μm, the magnetic iron oxide particles are too large for the toner particles, so that the magnetic iron oxide can not be uniformly present in the toner particles.

In the present invention, the average particle diameter and cumulative number percentage of the magnetic iron oxide particles are determined by statistically processing particle diameters obtained by observation using a scanning electron microscope (SEM) and a transmission electron microscope (TEM).

In the magnetic toner of the present invention, the magnetic iron oxide particles may preferably be contained in the magnetic toner particles in an amount of from 20 to 200 parts by weight, and more preferably from 30 to 150 parts by weight, based on 100 parts by weight of the binder resin.

If the content of the magnetic iron oxide particles in the magnetic toner particles is less than 20 parts by weight, the magnetic toner particles may have an excessively large charge quantity to cause a phenomenon of charge-up, resulting in a decrease in image density. If it is more than 200 parts by weight, the magnetic toner particles may have a small charge quantity to cause black spots around line images (caused by toner scattering).

In the present invention, it is more preferable for the magnetic toner to have a particle size distribution that fulfills the following conditions where weight average particle diameter (D4) is represented by X (μm) and number-based percentage of the magnetic toner particles with particle diameters of 3.17 μm or smaller as determined from number distribution is represented by Y (% by number):

$$-5X+35 \leqq Y \leqq -25X+180,\ 3.5 \leqq X \leqq 6.5$$

An instance where the X (μm) of the weight average particle diameter (D4) is larger than 6.5 (μm) is not preferable because sharpness of characters or fine lines may become poor. An instance where it is smaller than 3.5 (μm) is also not preferable because the magnetic toner tends to undergo charge-up to cause a problem of a decrease in image density.

An instance where the Y (% by number) of the magnetic toner particles with particle diameters of 3.17 μm is smaller than −5X+35 is not preferable because reproducibility of one dot and resolution may lower. An instance where it is smaller than −25X+180 is also not preferable because fogging in non-image areas may increase.

The magnetic toner of the present invention may preferably also have a volume average particle diameter (Dv) of from 2.5 μm to 6.0 μm.

If the magnetic toner has a volume average particle diameter (Dv) smaller than 2.5 μm, it may be difficult to obtain a sufficient image density. If the magnetic toner has a volume average particle diameter (Dv) larger than 6.0 μm, the particle diameters of the whole toner are different from diameters of particles that constitute fine powder and hence such a toner can not be effective for preventing the formation of a toner fine-powder layer on the toner carrying member, tending to cause "sleeve ghost".

The average particle diameter and particle size distribution of the magnetic toner are measured using a Coulter counter Model TA-II or Coulter Multisizer (manufactured by Coulter Electronics, Inc.). As an electrolytic solution, an aqueous 1% NaCl solution is prepared using first-grade sodium chloride. For example, ISOTON R-II (trade name, manufactured by Coulter Scientific Japan Co.) may be used. Measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for from about 1 minute to about 3 minutes in an ultrasonic dispersion machine. The volume distribution and number distribution of the toner are calculated by measuring the volume and number of toner particles of 2 μm or larger diameters by means of the above Coulter counter Model TA-II, using an aperture of 100 μm as its aperture. Then the weight-based, weight average particle diameter (D4) determined from the volume distribution of toner particles, the volume average particle diameter (Dv) (the middle value of each channel is used as the representative value for each channel) and the number-based percentage of particles with particle diameters of 3.17 μm or smaller as determined from number distribution are determined.

The binder resin that can be used in the present invention may include homopolymers of styrene or derivatives thereof such as polystyrene, poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethanes, polyamide resins, furan resins, epoxy resins, xylene resins, polyvinyl butyral, terpene resins, cumarone indene resins, and petroleum resins. Also, cross-linked styrene resins are preferred binder resins.

Comonomers copolymerizable with styrene monomers in styrene copolymers may include vinyl monomers, any of which may be used alone or in combination of two or more. The vinyl monomers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether.

As a cross-linking agent used for synthesizing the cross-linked styrene resins, compounds having at least two polymerizable double bonds may be used. Such compounds having at least two polymerizable double bonds may include aromatic divinyl compounds as exemplified by divinyl benzene and divinyl naphthalene; carboxylates having two double bonds as exemplified by ethylene glycol diacrylate, ethylene glycol dimethacrylate and 1,3-butanediol dimethacrylate; divinyl compounds as exemplified by divinyl aniline, divinyl ether, divinyl sulfide and divinyl sulfone; and compounds having at least three vinyl groups; any of which may be used alone or in the form of a mixture.

As a method for polymerizing high-molecular weight components of the binder resin, it may include emulsion polymerization and suspension polymerization.

In particular, the emulsion polymerization is a method in which monomers almost insoluble in water are dispersed in an aqueous phase in the form of small particles by the use of an emulsifying agent and then polymerized using a water-soluble polymerization initiator. In this method, the heat of reaction can be readily controlled and the phase where polymerization takes place (an oily phase comprised of polymers and monomers) and the aqueous phase are separated, and hence the rate of termination reaction can be low, so that the rate of polymerization can be high, making it possible to obtain a product with a high degree of polymerization. In addition, because of a relative simple polymerization process and also because of a polymerization product formed of fine particles, the product can be readily mixed with colorants, charge control agents and other additives in the manufacture of toners, and hence this method has an advantage as a method of producing binder resins for toners.

The emulsion polymerization, however, tends to make the resulting polymer impure because of the emulsifying agent added, and also requires operations such as salting-out to take out the polymer. To avoid such a disadvantage, the suspension polymerization is preferred.

The suspension polymerization may be carried out using monomers in an amount of not more than 100 parts by weight, and preferably from 10 to 90 parts by weight, based on 100 parts by weight of a water-based solvent. Usable dispersants may include polyvinyl alcohol, a polyvinyl alcohol partially saponified product, and calcium phosphate. The amount of the dispersants can be determined according to monomer content in an aqueous solvent. Usually, any of these dispersants may be used in an amount of from 0.05 to 1 part by weight based on 100 parts by weight of the water-based solvent. It is suitable to carry out the polymerization at a temperature of from 50° C. to 95° C., which should be appropriately selected according to polymerization initiators to be used and the intended polymer.

As methods for synthesizing low-molecular weight components of the binder resin according to the present invention, known methods may be used. In bulk polymerization, low-molecular weight polymers can be obtained by carrying out the polymerization at a high temperature and accelerating the rate of termination reaction. There, however, is the problem of a difficulty in reaction control. In that respect, in solution polymerization, low-molecular weight polymers can be readily obtained under mild conditions by utilizing a difference in chain transfer of radicals, ascribable to solvents, or controlling the amount of initiators and the reaction temperature. Thus the latter is preferred when a low-molecular weight component is formed in the binder resin used in the present invention. In particular, in order to highly control acid components and molecular weight, it is possible to use, e.g., a method in which a polymer having different molecular weight and composition is mixed to obtain a low-molecular weight polymer, or a method in which monomers having different composition are post-added.

As solvents used in the solution polymerization, they may include xylene, toluene, cumene, cellosolve acetate, isopropyl alcohol and benzene. In the case of a mixture of styrene monomers, xylene, toluene or cumene is preferred. The solvent may be appropriately selected according to the polymers to be produced by polymerization.

In the present invention, a wax may preferably be optionally contained in the magnetic toner particles. Usable wax may include, e.g., paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and products graft-modified with vinyl monomers.

Wax preferably used in the present invention is a low-molecular weight wax represented by the following formula.

R—Y wherein R represents a hydrocarbon group, and Y represents a hydrogen atom, a hydroxyl group, a carboxyl group, an alkyl ether group, an ester group or a sulfonyl group. The wax represented by R—Y may have a weight average molecular weight (Mw) of not more than 3,000 as measured by GPC.

As examples of specific compounds, the wax may include those having any of the following alcohol components;

(A) $CH_3(CH_2)_nCH_2OH$ (n represents an average value, and is from 20 to 300, and preferably from 34 to 149)

(B) $CH_3(CH_2)_nCH_2COOH$ (n represents an average value, and is from 20 to 300, and preferably from 35 to 150)

(C) $CH_3(CH_2)_n—O—(CHCH_2—O—)_m—H$ (n represents an average value, and is from 20 to 200, and preferably from 34 to 149)

(D)

$$CH_3(CH_2)x—O—(\underset{\underset{R}{|}}{CH}CH_2—O)_z—H$$

(x represents an average value, and is from 35 to 150; z represents an average value, and is from 1 to 5; and R represents a hydrogen atom or an alkyl group having 1 to 10 carbon atoms)

These compounds are derivatives of the compound (A), and have a straight-chain saturated hydrocarbon as the backbone chain. Compounds other than those exemplified above may be used so long as they are derivatives of the compound (A). Use of the above wax makes it possible to highly satisfy low-temperature fixing performance and high-temperature anti-offset properties.

Of the above compounds, a high-molecular weight alcohol represented by the formula (A), (A) $CH_3(CH_2)_nCH_2OH$ (n is 20 to 300) used as a main component is preferred. This wax has a good lubricity and especially has superior anti-offset properties. In the present invention, what is meant by the main component is an instance where it is contained in an amount of at least 50% by weight based on the weight of the whole low-molecular weight wax.

The low-molecular weight wax used in the present invention may have a weight average molecular weight (Mw) of not more than 3,000, and may preferably a wax having a number average molecular weight (Mn) of from 200 to 2,000, and preferably from 300 to 1,200, a weight average molecular weight (Mw) of from 400 to 3,000, and preferably from 800 to 2,500, and Mw/Mn of not more than 3.

When the wax has such molecular weight distribution, the magnetic toner can be endowed with preferable charging performance. If it has smaller number average molecular weight and weight average molecular weight than the above ranges, the wax tends to be excessively affected by charging to tend to cause fogging and toner scattering. If it has larger number average molecular weight and weight average molecular weight than the above ranges, the wax tends to have a poor dispersibility in other materials constituting the magnetic toner.

In the present invention, the molecular weight distribution of the wax is measured by GPC (gel permeation chromatography) under conditions shown below.

GPC measurement conditions

Apparatus: GPC-150C (Waters Co.)

Columns: GMH-HT, two series (available from Tosoh Corporation)

Temperature: 135° C.

Solvent: O-Dichlorobenzene (0.1% ionol-added)

Flow rate: 1.0 ml/min

Sample: 0.4 ml of sample with a concentration of 0.15% by weight is injected.

Measured under conditions shown above. Molecular weight of the sample is calculated using a molecular weight calibration curve prepared from a monodisperse polystyrene standard sample. It is calculated by further converting the value according to a conversion formula derived from the Mark-Houwink viscosity formula.

In the present invention, any of these waxes may preferably be contained in the magnetic toner particles in an amount of from 0.5 part by weight to 20 parts by weight, and more preferably from 2 parts by weight to 10 parts by weight, based on 100 parts by weight of the binder resin. If the wax is contained in the magnetic toner particles in an amount less than 0.5 part by weight, it may have an insufficient release effect in the fixing step to badly cause offset. If it is in an amount more than 20 parts by weight, the wax present on the surfaces of the magnetic toner particles may be too much to make it possible for the magnetic toner particles to have a sufficient charge quantity.

In the present invention, a negative charge control agent may preferably be added to the magnetic toner to provide a negatively chargeable magnetic toner.

As specific examples of the negative charge control agent, it may include metal complexes of monoazo dyes as disclosed in Japanese Patent Publication No. 41-20153, No. 42-27596, No. 44-6397 and No. 45-26478, nitroamine acids and salts thereof as disclosed in Japanese Patent Application Laid-open No. 50-133338 or dyes and pigments such as C.I. 14645, metal complexes such as Zn, Al, Co, Cr or Fe complexes of salicylic acid, naphthoic acid or dicarboxylic acid as disclosed in Japanese Patent Publication No. 55-42752, No. 58-41508, No. 58-7384 and No. 59-7385, sulfonated copper phthalocyanine pigments, styrene oligomers incorporated with a nitro group or a halogen, and chlorinated paraffins. In particular, an azo metal complex represented by Formula (1) and a basic organic acid metal complex represented by Formula (2) as shown below are preferred, which have a superior dispersibility and are effective for stabilizing image density or less causing fogging.

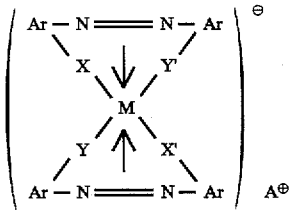

(1)

In the formula, M represents a central metal of coordination, as exemplified by Cr, Co, Ni, Mn, Fe, Ti or Al. Ar represents an aryl group as exemplified by a phenyl group or a naphthyl group, which may have a substituent. In such a case, the substituent includes a nitro group, a halogen atom, a carboxyl group, an anilido group, an alkyl group having 1 to 18 carbon atoms and an alkoxyl group having 1 to 18 carbon atoms. X, X', Y and Y' each represent —O—, —CO—, —NH— or —NR— (R is an alkyl group having 1 to 4 carbon atoms). $A^+$ represents a hydrogen ion, a sodium ion, a potassium ion, an ammonium ion or an aliphatic ammonium ion.

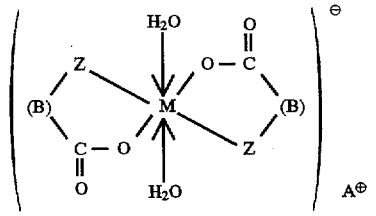

(2)

In the formula, M represents a central metal of coordination, as exemplified by Cr, Co, Ni, Mn, Fe, Ti or Al. B represents;

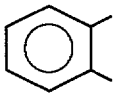

(which may have a substituent such as an alkyl group)

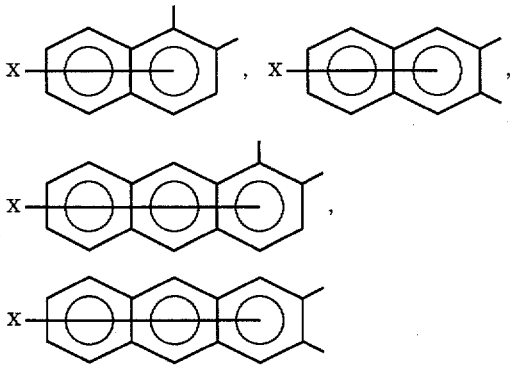

(X represents a hydrogen atom, a halogen atom or a nitro group), and

-continued

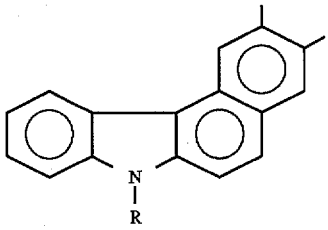

(R represents a hydrogen atom, an alkyl group having 1 to 18 carbon atoms or an alkenyl group having 2 to 18 carbon atoms);

$A^+$ represents hydrogen, a sodium ion, a potassium ion, an ammonium ion or an aliphatic ammonium ion. Z represents —O— or $$-\overset{O}{\overset{\|}{C}}-O-.$$

Of these, the azo metal complexes represented by Formula (1) are preferred. In particular, an azo iron complex represented by the following Formula (3) is most preferred.

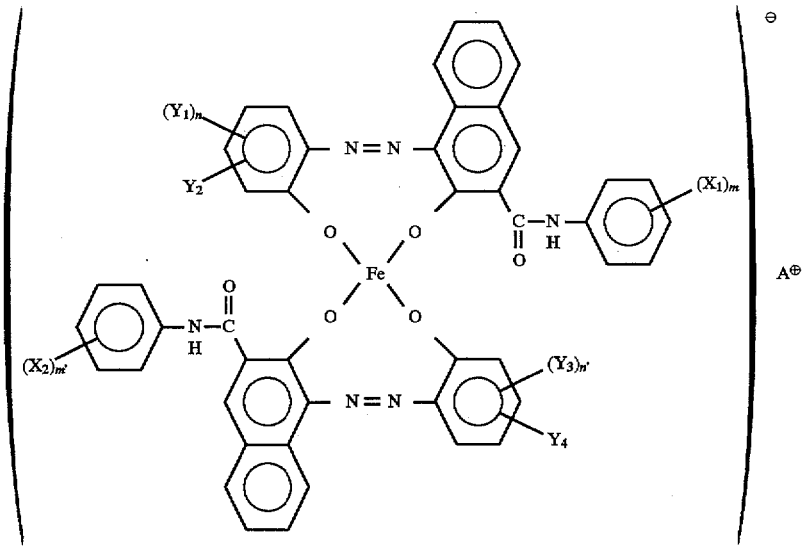

(3)

wherein $X_1$ and $X_2$ each represent a hydrogen atom, a lower alkyl group, a lower alkoxyl group, a nitro group or a halogen atom, and m and m' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group or a halogen atom, and n and n' each represent an integer of 1 to 3; $Y_2$ and $Y_4$ each represent a hydrogen atom or a nitro group; provided that the above $X_1$ and $X_2$, m and m', $Y_1$ and $Y_3$, n and n', and $Y_2$ and $Y_4$ may be the same or different; and $A^+$ represents an ammonium ion, an alkali metal ion, a hydrogen ion or a mixed ion of any of these.

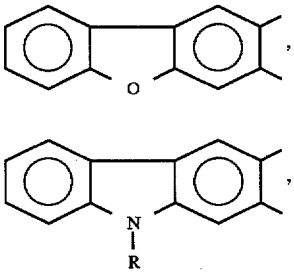

Specific examples of the azo iron complex represented by Formula (3) are shown below.

Azo iron complex compound (1)
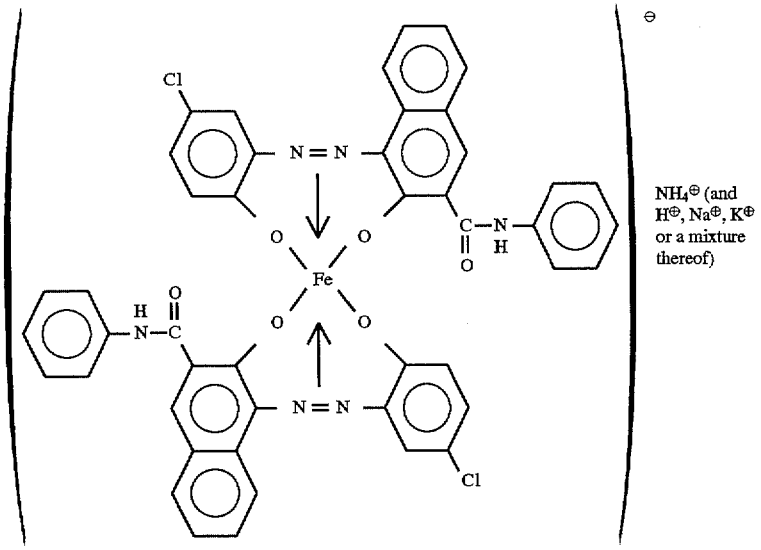
Azo iron complex compound (2)
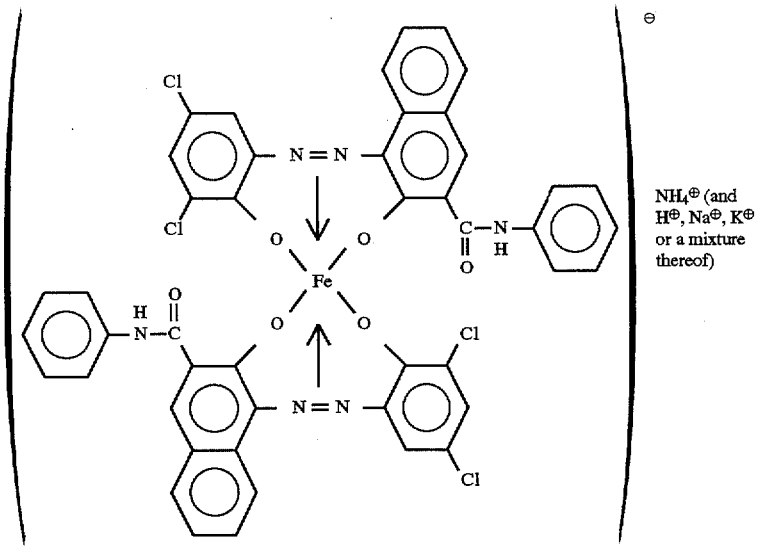

-continued
Azo iron complex compound (3)
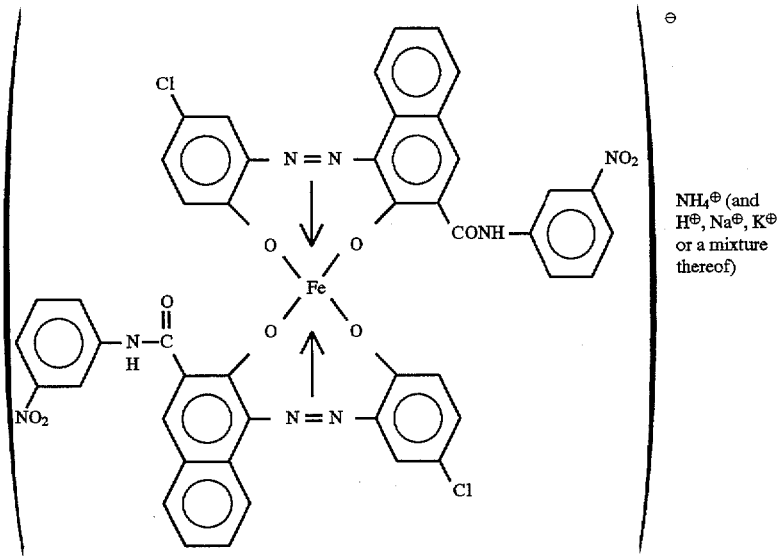
Azo iron complex compound (4)
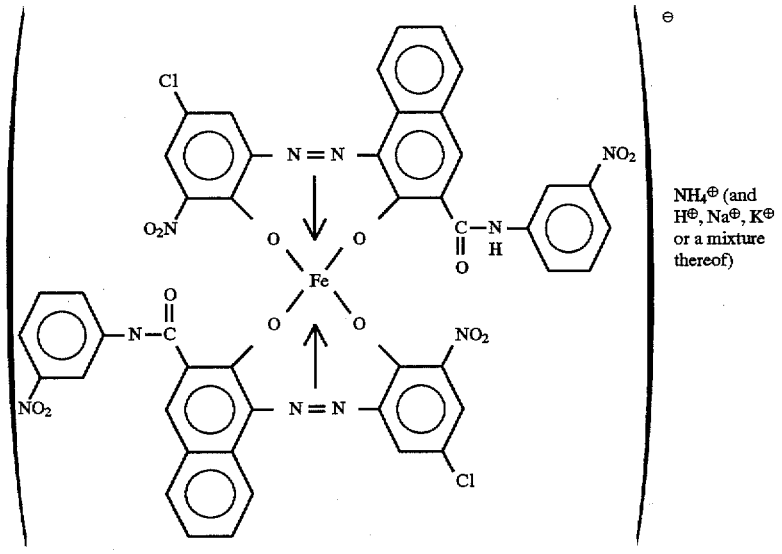

-continued

Azo iron complex compound (5)

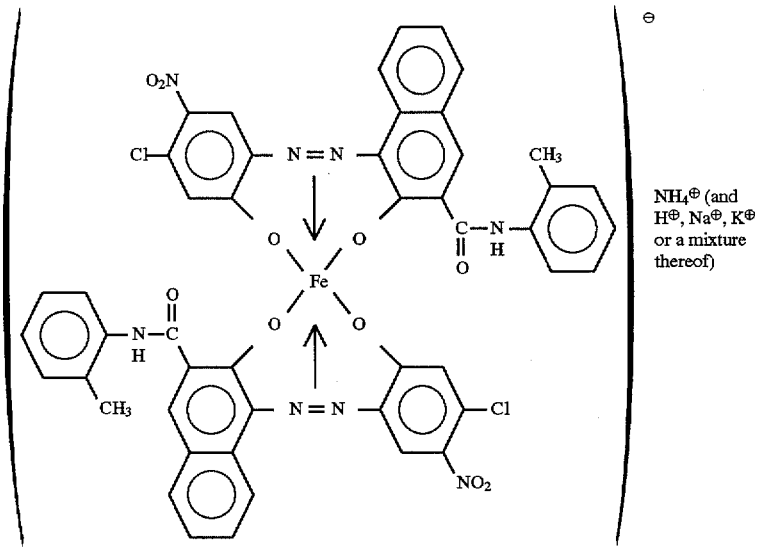

Azo iron complex compound (6)

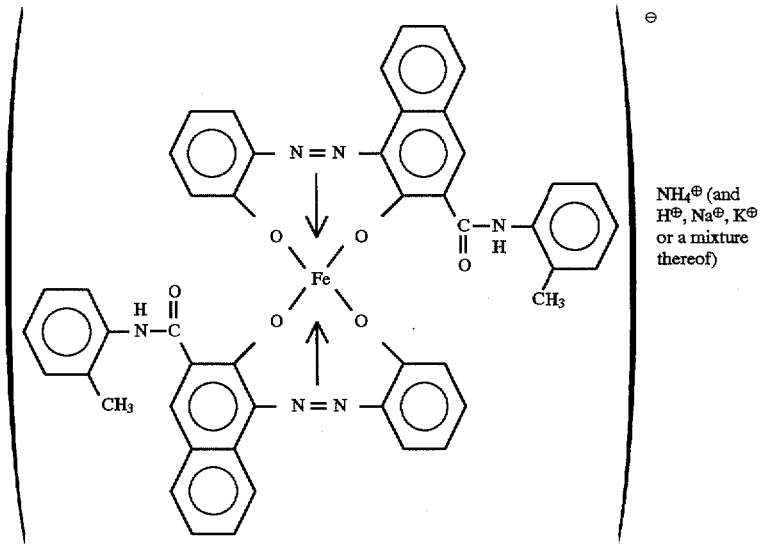

In particular, as a charge control agent usable in the present invention and more effective one, it may include a naphthoic acid iron complex represented by the following Formula (4).

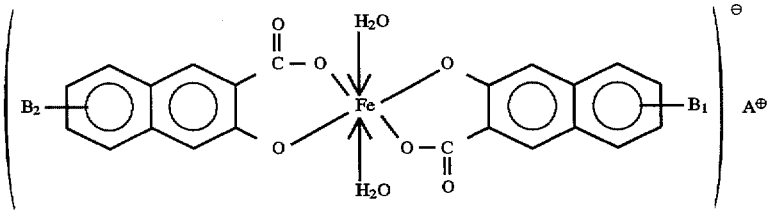

(4)

In the formula, $A^+$ represents an ammonium ion, an alkali metal ion, a hydrogen ion or a mixed ion of any of these; and $B_1$ and $B_2$ each represent a hydrogen atom or an alkyl group.

In the case when a positive charge control agent is added to the magnetic toner to the present invention to provide a positively chargeable magnetic toner, the positive charge control agent may include Nigrosine and its products modified with a fatty acid metal salt; quaternary ammonium salts such as tributylbenzylammonium 1-hydroxy-4-naphthoslulfonate and tetrabutylammonium teterafluoroborate, and analogues of these, i.e., onium salts such as phosphonium salts, and lake pigments of these; triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; guanidine compounds; and imidazole compounds. Any of these may be used alone or in combination of two or more. Of these, triphenylmethane dyes compounds and quaternary ammonium salts whose counter ions are not halogens may preferably be used. Homopolymers of monomers represented by the following Formula (5);

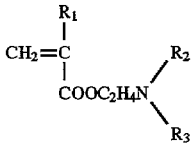

(5)

wherein $R_1$ represents H or $CH_3$; $R_2$ and $R_3$ each represent a substituted or unsubstituted alkyl group (preferably having 1 to 4 carbon atoms); or copolymers of polymerizable monomers such as styrene, acrylates or methacrylates as previously described with the monomer represented by the above Formula (5) may also be used as positive charge control agents. In this case, these charge control agents can also act as binder resins (as a whole or in part).

The charge control agent described above may preferably be contained in an amount of from 0.1 to 5 parts by weight, and more preferably from 0.2 to 3 parts by weight, based on 100 parts by weight of the binder resin of the toner. If the charge control agent is contained in excess, the magnetic toner may have a poor fluidity to tend to cause fogging. If it is in a too small proportion, a sufficient charge quantity may be obtained with difficulty.

In the magnetic toner for developing an electrostatic image according to the present invention, it is preferable to mix an inorganic fine powder or a hydrophobic inorganic fine powder in order to improve environmental stability, charging stability, developing performance, fluidity and storage stability. It may include, e.g., fine silica powder, fine titanium oxide powder, and any of these having been made hydrophobic. These may preferably be used alone or in combination.

The fine silica powder may be what is called dry process silica or fumed silica, produced by vapor phase oxidation of silicon halides, or what is called wet process silica, produced from water glass or the like, either of which may be used. The dry process silica is preferred, as having less silanol groups on the surface and inside and leaving no production residue such as $Na_2O$ and $SO_3^{2-}$. In the dry process silica, other metal halide as exemplified by aluminum chloride or titanium chloride may also be used together with the silicon halide in the course of production to obtain a composite fine powder of silica with other metal oxide, which is also included in the dry process silica.

The fine silica powder may preferably be those having been made hydrophobic. It can be made hydrophobic by chemical treatment with an organosilicon compound or the like capable of reacting with or physically adsorbing the fine silica powder. As a preferable method, a dry process fine silica powder produced by vapor phase oxidation of a silicon halide may be treated with an organosilicon compound such as silicone oil after the powder has been treated with a silane coupling agent, or at the same time it is treated with a silane coupling agent.

The silane coupling agent used in such hydrophobic treatment may include, e.g., hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trirmethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyltetramethyldisiloxane, and a dimethylpolysiloxane having 2 to 12 siloxane units per molecule and containing a hydroxyl group bonded to each silicon atom in its units positioned at the terminals.

The organosilicon compound may include silicone oils. Silicone oils preferably used are those having a viscosity of from 30 to 1,000 centistokes at 25° C. For example, dimethyl silicone oil, methylphenyl silicone oil, α-methylstyrene modified silicone oil, chlorophenyl silicone oil and fluorine modified silicone oil are preferred.

The treatment with silicone oil may be made by a method in which, e.g., the fine silica powder treated with a silane coupling agent and the silicone oil are directly mixed by means of a mixing machine such as a Henschel mixer, or the silicone oil is sprayed on the fine silica powder serving as a base. Alternatively, the silicone oil may be dissolved or dispersed in a suitable solvent and thereafter the solution or dispersion may be mixed with the base fine silica powder, followed by removal of the solvent To the magnetic toner for developing an electrostatic image according to the present invention, external additives other than the fine silica powder or fine titanium oxide powder may be optionally added.

They are exemplified by fine resin particles or inorganic fine particles that act as a charging auxiliary agent, a conductivity-providing agent, a fluidity-providing agent, an anti-caking agent, a release agent at the time of heat roll fixing, a lubricant or an abrasive.

For example, lubricants such as Teflon, zinc stearate and polyvinylidene fluoride, in particular, polyvinylidene fluoride, are preferred. Abrasives such as cerium oxide, silicon carbide and strontium titanate, in particular, strontium titanate are also preferred. Fluidity-providing agents such as titanium oxide and aluminum oxide, in particular, hydrophobic one, are also preferred. Anti-caking agents, conductivity-providing agents such as carbon black, zinc oxide, antimony oxide and tin oxide, and, as a developability improver, white fine particles and black fine particles having the polarity opposite to the charge polarity of the toner particles may also be used in small quantities.

The fine resin particles, inorganic fine particles or hydrophobic inorganic fine particles mixed in the toner particles may preferably be used in an amount of from 0.1 to 5 parts by weight, and more preferably from 0.1 to 3 parts by weight, based on 100 parts by weight of the magnetic toner.

A preferred specific example of the image forming process of the present invention will be described with reference to FIG. 3.

The surface of a photosensitive drum (a latent image bearing member) 3 comprising an OPC (organic photoconductive material) is negatively charged by a primary corona assembly 11 serving as a contact charging member comprising a charging roller, and exposed to laser light 5 to form a digital latent image by image scanning. The latent image thus formed is reverse developed using a triboelectrically negatively chargeable magnetic toner which is held in a developing assembly 1 serving as a developing means, having an elastic blade 8 made of urethane rubber provided in the counter direction and a developing sleeve 6 internally provided with a magnet 15. Alternatively, using an amorphous silicone photosensitive member, the photosensitive member is positively charged to form an electrostatic latent image, and the latent image is regularly developed using a triboelectrically positively chargeable magnetic toner. In the developing zone, an AC bias, a pulse bias and/or a DC bias is/are applied to the developing sleeve 6 through a bias applying means 12. A transfer medium P is delivered to the transfer zone, where the transfer medium P is electrostatically charged on its back surface (the surface opposite to the photosensitive drum) through a contact transfer member 4 comprising a transfer roller, serving as transfer means, so that a toner image formed on the surface of the photosensitive drum is electrostatically transferred to the transfer medium P. The transfer medium P separated from the photosensitive drum 3 is subjected to fixing using a heat-pressure fixing assembly having a heating roller internally provided with a heating means 20 and having a pressure roller 22, in order to fix the toner image held on the transfer medium P.

The magnetic toner remaining on the photosensitive drum 3 after the transfer step is removed by the operation of a cleaning means 14 having a cleaning blade 7. After the cleaning, the the surface of the photosensitive drum 3 is destaticized by erase exposure 10, and thus the procedure again starting from the charging step using the primary corona assembly 11 is repeated.

The latent image bearing member (photosensitive drum) comprises a photosensitive layer and a conductive substrate, and is rotated in the direction of an arrow. In the developing zone, the developing sleeve 6, formed of a non-magnetic cylinder, which is a developer carrying member, is rotated so as to move in the same direction as the direction in which the latent image bearing member is rotated. Inside the non-magnetic cylinder, developing sleeve 6, a multi-polar permanent magnet 15 (magnet roll) serving as a magnetic field generating means is provided in an unrotatable state. The magnetic toner 13 held in the developing assembly 1 is coated on the surface of the non-magnetic cylinder, and negative triboelectric charges are imparted to the magnetic toner particles because of the friction between the surface of the developing sleeve 6 and the magnetic toner particles. An elastic doctor blade 8 is also disposed, whereby the thickness of toner layer is controlled to be small (30 μm to 300 μm) and uniform so that a toner layer smaller in thickness than the gap between the photosensitive drum 3 and the developing sleeve 6 in the developing zone is formed in a non-contact state. The rotational speed of this developing sleeve 6 is regulated so that the peripheral speed of the sleeve can be substantially equal or close to the speed of the peripheral speed of the latent image bearing member.

An AC bias or a pulse bias may be applied to the developing sleeve 6 through a bias means. This AC bias may have a frequency (f) of from 200 to 4,000 Hz and a Vpp of from 500 to 3,000 V.

When the magnetic toner particles are moved in the developing zone, the magnetic toner particles move to the side of the electrostatic image by the electrostatic force of the surface of the photosensitive drum 3 and the action of the AC bias or pulse bias.

Among the above constituents such as the latent image bearing member (as the photosensitive drum), the developing assembly and the cleaning means, some constituents may be joined into one unit as an apparatus unit to make up a process cartridge, and this process cartridge may be detachably mounted to the main body of the apparatus. For example, the charging means and the developing assembly may be held into one unit together with the photosensitive drum to make up the process cartridge as a single unit detachably mountable to the apparatus main body so that it can be freely mounted or detached using a guide means such as rails provided in the apparatus main body. In this instance, the process cartridge may be made up to have also the cleaning means.

Figure 4:
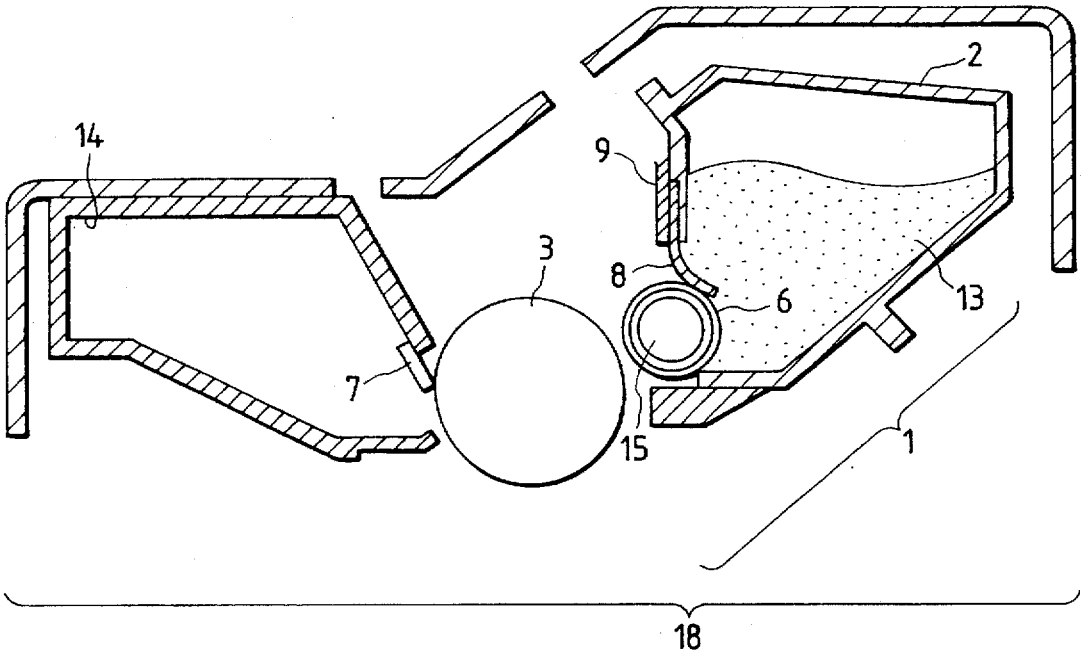
FIG. 4 is a schematic illustration of the process cartridge according to the present invention.

FIG. 4 schematically illustrates an example of the process cartridge. In this example, it is a process cartridge 18 having a developing assembly 1, a drum type latent image bearing member (a photosensitive drum) 3, a cleaner 14 and a primary charging assembly 11, which are held into one unit.

The process cartridge is changed for a new process cartridge when a magnetic toner 13 of the developing assembly 1 is used up.

In this example, developing assembly 1 holds the magnetic toner 13. When the latent image is developed, a stated electric field is formed between the photosensitive drum 3 and a developing sleeve 6. In order to preferably carry out the development, the distance between the photosensitive drum 3 and the developing sleeve 6 is very important. In this example, it is around, e.g., 300 μm and is controlled so as to be within an error of plus-minus 20 μm.

In the process cartridge as shown in FIG. 4, the developing assembly 1 has a toner container 2 for holding the magnetic toner 13, the developing sleeve 6, which carries thereon the magnetic toner 13 held in the toner container 2 and transports it from the toner container 2 to the developing zone facing the latent image bearing member 3, and an elastic blade 8 for controlling to a stated thickness the magnetic toner carried on the developing sleeve 6 and transported to the developing zone, to form a thin toner layer on the developing sleeve.

The developing sleeve 6 may have any desired structure. For example, it is constituted of a non-magnetic developing sleeve 6 internally provided with a magnet 15. The developing sleeve 6 may be a cylindrical rotary member as shown in FIG. 4, or may be a belt-like member that is circulatingly movable. As a material therefor, usually it is preferable to use aluminum or stainless steel.

The elastic blade 8 may be constituted of an elastic plate formed of a rubber elastic material such as urethane rubber, silicone rubber or NBR; a metal elastic material such as phosphor bronze or stainless steel sheet; or a resin elastic material such as polyethylene terephthalate or high-density polyethylene. The elastic blade 8 is brought into touch with the developing sleeve 6 by its own elasticity, and is secured to the toner container 2 through a blade support member 9 formed of a rigid material such as iron. The elastic blade 8 may preferably be brought into touch with the developing sleeve 6 at a linear pressure of from 5 to 80 g/cm in the counter direction with respect to the rotational direction of the developing sleeve 6.

As the contact charging member, a blade-like charging blade may be used in place of the charging roller described above. The magnetic toner of the present invention can also effectively prevent this charging blade from contamination.

Figure 5:
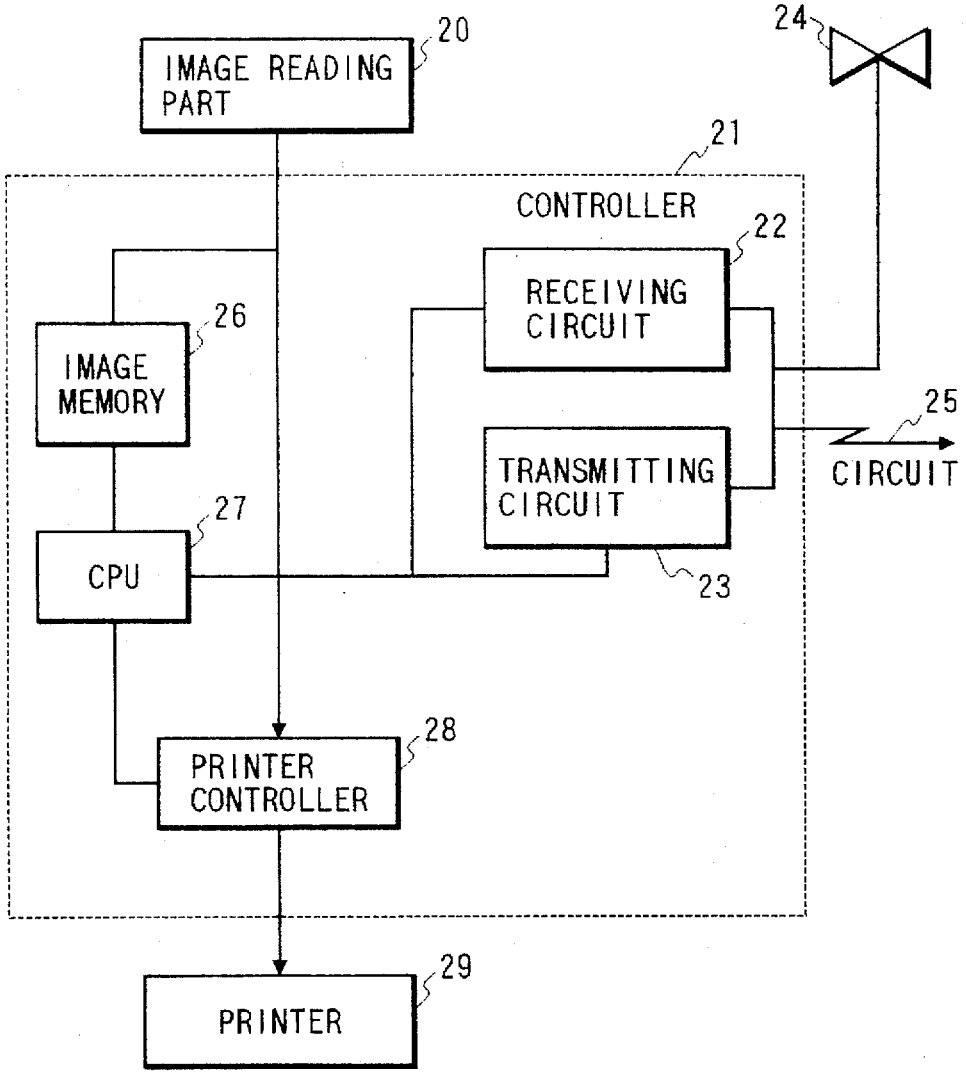
FIG. 5 is a block diagram of an instance where the image forming process of the present invention is applied in a printer of a facsimile machine.

In the case when the image forming process of the present invention is applied in a printer of a facsimile machine, optical image exposing light L serves as exposing light used for the printing of received data. FIG. 5 illustrates an example thereof in the form of a block diagram.

A controller 21 controls an image reading part 20 and a printer 29. The whole of the controller 21 is controlled by CPU 27. Reading data outputted from the image reading part is sent to the other facsimile station through a transmitting circuit 23. Data received from the other station is sent to a printer 29 through a receiving circuit 22. Given image data are stored in an image memory 26. A printer controller 28 controls the printer 29. The numeral 24 denotes a telephone.

An image received from a circuit 25 (image information from a remote terminal connected through the circuit) is demodulated in the receiving circuit 22, and then successively stored in an image memory 26 after the image information is decoded by the CPU 27. Then, when images for at least one page have been stored in the memory 26, the image recording for that page is carried out. The CPU 27 reads out the image information for one page from the memory 26 and sends the encoded image information for one page to the printer controller 28. The printer controller 28, having received the image information for one page from the CPU 27, controls the printer 29 so that the image information for one page is recorded.

The CPU 27 receives image information for next page in the course of the recording by the printer 29.

According to the present invention, since the magnetic iron oxide particles are surface-treated with the specific aliphatic alcohol, the adhesion of the surface-treated magnetic iron oxide particles to the binder resin can be improved and the magnetic iron oxide can be prevented from coming off from the magnetic toner particles, whereby the charging member can be prevented from being contaminated.

The basic constitution and characteristic features of the present invention have been described above. The present invention will be described below in greater detail by giving Examples. It should be noted that embodiments of the present invention are by no means limited by these. In the following Examples and Comparative Examples, "part(s)" is "part(s) by weight".

Magnetic Iron Oxide Particles,

Preparation Example 1

In an aqueous ferrous sulfate solution, sodium silicate was added so as to be in a content of 1.5% as silicon element on the basis of iron element, and thereafter a sodium hydroxide solution of from 1.0 to 1.1 in equivalent weight on the basis of iron ions was mixed, thus an aqueous solution containing ferrous hydroxide was prepared.

Into the aqueous solution, air was blown while maintaining its pH at from 7 to 10 (e.g., pH 9), and oxidation reaction was carried out at from 80° C. to 90° C., thus a slurry for forming seed crystals was prepared.

Next, to this slurry, the aqueous ferrous sulfate solution was added so as to be in an equivalent weight of from 0.9 to 1.2 on the basis of the initial alkali weight (sodium component of the sodium silicate and sodium component of the sodium hydroxide). Thereafter, the oxidation reaction was allowed to proceed while maintaining the pH of the slurry to from 6 to 10 (e.g., pH 8) and while blowing air into it. At the termination of the oxidation reaction, the pH was adjusted to localize the silicic acid component to the surfaces of the magnetic iron oxide particles. The magnetic iron oxide particles thus formed were washed, filtered and dried by conventional methods, followed by disintegration of particles agglomerating, to obtain a magnetic iron oxide having the characteristics as shown in Table 1.

The amount of dissolution of iron element and that of silicon element were measured at intervals of 10 minutes to obtain the data as shown in Table 1. The relationship of solubility between iron element and silicon element of the magnetic iron oxide is shown in FIG. 1.

In the magnetic iron oxide obtained in Preparation Example 1, the content C of silicon element originating from the silicon compound such as silicic acid dissolved by the alkali, present on the surfaces of the magnetic iron oxide particles, was 14.9 mg/l, and the content B of silicon element originating from the silicon compound present in the surface portions of the magnetic iron oxide particles was 32.3 mg/l. The content A was 49.8 mg/l.

Magnetic Iron Oxide Particles,

Preparation Example 2

A magnetic iron oxide having the characteristics as shown in Table 2 was obtained in the same manner as in Preparation Example 1 except that the sodium silicate was added so as to be in a content of 1.0% as silicon element on the basis of iron element.

Magnetic Iron Oxide Particles,

Preparation Example 3

A magnetic iron oxide having the characteristics as shown in Table 2 was obtained in the same manner as in Preparation Example 1 except that the sodium silicate was added so as to be in a content of 2.8% as silicon element on the basis of iron element.

Magnetic Iron Oxide Particles,

Preparation Example 4

A magnetic iron oxide having the characteristics as shown in Table 2 was obtained in the same manner as in Preparation Example 1 except that the sodium silicate was added so as to be in a content of 5.8% as silicon element on the basis of iron element.

Magnetic Iron Oxide Particles,

Preparation Example 5

A magnetic iron oxide having the characteristics as shown in Table 2 was obtained in the same manner as in Preparation Example 1 except that the sodium silicate was not added.

TABLE 1

| | Dissolution time (minute) | | | | | | | | | | | |
|---|---|---|---|---|---|---|---|---|---|---|---|---|
| | 10 | 20 | 30 | 40 | 50 | 60 | 70 | 80 | 90 | 100 | 110 | 120 |
| Iron element dissolution: (mg/l) | 335 | 635 | 1,280 | 1,795 | 2,160 | 2,455 | 2,655 | 2,890 | 3,055 | 3,220 | 3,285 | 3,320 |
| Iron element solubility: (wt. %) | 10.1 | 19.1 | 38.6 | 54.1 | 65.1 | 73.9 | 80.0 | 87.0 | 92.0 | 97.0 | 98.9 | 100 |
| Silicon element dissolution: (mg/l) | 25.3 | 31.8 | 36.3 | 38.8 | 40.3 | 42.3 | 43.3 | 44.8 | 45.8 | 47.8 | 49.3 | 49.8 |

TABLE 1-continued

| | Dissolution time (minute) | | | | | | | | | | | |
|---|---|---|---|---|---|---|---|---|---|---|---|---|
| | 10 | 20 | 30 | 40 | 50 | 60 | 70 | 80 | 90 | 100 | 110 | 120 |
| Silicon element solubility: (wt. %) | 51 | 64 | 73 | 78 | 81 | 85 | 87 | 90 | 92 | 96 | 99 | 100 |

TABLE 2

| Preparation Example: | Silicon content (%) | (B/A) × 100 (%) | (C/A) × 100 (%) | Number average particle diameter (μm) |
|---|---|---|---|---|
| 1 | 1.5 | 65 | 30 | 0.20 |
| 2 | 1.0 | 77 | 42 | 0.40 |
| 3 | 2.8 | 55 | 13 | 0.12 |
| 4 | 5.8 | 82 | 64 | 0.34 |
| 5 | 0 | — | — | 0.25 |

The magnetic iron oxides thus obtained were surface-treated with the aliphatic alcohol as shown in the following Examples and put to use. These were each surface-treated by putting in a Henschel mixer 100 parts of the magnetic iron oxide and a stated amount of the alcohol shown in each Example, followed by mixing.

EXAMPLE 1

| | |
|---|---|
| Styrene/butyl acrylate/monobutyl maleate copolymer (copolymerization ratio: 75/20/5) | 100 parts |
| Magnetic iron oxide A obtained by surface-treating 100 parts of the magnetic iron oxide of Preparation Example 1 with 1 part of a higher alcohol (average number of carbon atoms: n = 50) | 101 parts |
| Exemplary, azo iron complex compound (1) | 2 parts |
| Aliphatic alcohol wax (Mw: 700) | 4 parts |

The above materials were premixed and then melt-kneaded using a twin-screw extruder set at 130° C. The kneaded product obtained was cooled, and then crushed. The crushed product was finely pulverized by using jet streams, and the finely pulverized product thus obtained was classified using an air classifier to obtain toner particles having a weight average particle diameter of 5.5 μm and a volume average particle diameter of 5.0 μm and containing 20% by number of the particles of 3.17 μm or smaller. Then, 100 parts of the toner particles obtained were mixed with 1.0 part of negatively chargeable hydrophobic fine silica powder by means of a Henschel mixer to obtain a magnetic toner.

The magnetic iron oxide A was analyzed by DSC to reveal that it had one peak value at 100° C. in the region of from 60° C. to 150° C. of the DSC chart endothermic curve.

EXAMPLE 2

Toner particles having a weight average particle diameter of 5.6 μm and a volume average particle diameter of 5.1 μm and containing 17% by number of the particles of 3.17 μm or smaller were obtained in the same manner as in Example 1 except that the magnetic iron oxide A was replaced with 101 parts of magnetic iron oxide B obtained by surface-treating 100 parts of the magnetic iron oxide of Preparation Example 1 with 1 part of a higher alcohol (average number of carbon atoms: n=20) and the azo iron complex compound (1) was replaced with 2 parts of azo chromium complex compound. Then, 100 parts of the toner particles obtained were mixed with 1.0 part of negatively chargeable hydrophobic fine silica powder by means of a Henschel mixer to obtain a magnetic toner.

EXAMPLE 3

Toner particles having a weight average particle diameter of 6.1 μm and a volume average particle diameter of 5.7 μm and containing 13% by number of the particles of 3.17 μm or smaller were obtained in the same manner as in Example 1 except that the magnetic iron oxide A was replaced with 100.5 parts of magnetic iron oxide C obtained by surface-treating 100 parts of the magnetic iron oxide of Preparation Example 3 with 0.5 part of a higher alcohol (average number of carbon atoms: n=98) and the aliphatic alcohol wax was replaced with 4 parts of polypropylene wax (Mw: 5,000). Then, 100 parts of the toner particles obtained were mixed with 1.0 part of negatively chargeable hydrophobic fine silica powder by means of a Henschel mixer to obtain a magnetic toner.

EXAMPLE 4

Toner particles having a weight average particle diameter of 4.9 μm and a volume average particle diameter of 4.5 μm and containing 5% by number of the particles of 3.17 μm or smaller were obtained in the same manner as in Example 1 except that the magnetic iron oxide A was replaced with 103 parts of magnetic iron oxide D obtained by surface-treating 100 parts of the magnetic iron oxide of Preparation Example 1 with 3 parts of a higher alcohol (average number of carbon atoms: n=35) and the azo iron complex compound (1) was replaced with 2 parts of azo iron complex compound (2). Then, 100 parts of the toner particles obtained were mixed with 1.0 part of negatively chargeable hydrophobic fine silica powder by means of a Henschel mixer to obtain a magnetic toner.

EXAMPLE 5

Toner particles having a weight average particle diameter of 5.2 μm and a volume average particle diameter of 4.7 μm and containing 25% by number of the particles of 3.17 μm or smaller were obtained in the same manner as in Example 1 except that the magnetic iron oxide A was replaced with 100.5 parts of magnetic iron oxide E obtained by surface-treating 100 parts of the magnetic iron oxide of Preparation Example 5 with 0.5 part of a higher alcohol (average number of carbon atoms: n=50) and the azo iron complex compound (1) was replaced with 2 parts of azo iron complex compound (3). Then, 100 parts of the toner particles obtained were mixed with 1.0 part of negatively chargeable hydrophobic fine silica powder by means of a Henschel mixer to obtain a magnetic toner.

EXAMPLE 6

Toner particles having a weight average particle diameter of 4.7 μm and a volume average particle diameter of 4.1 μm and containing 30% by number of the particles of 3.17 μm or smaller were obtained in the same manner as in Example 1 except that the magnetic iron oxide A was replaced with 102 parts of magnetic iron oxide F obtained by surface-treating 100 parts of the magnetic iron oxide of Preparation Example 2 with 2 parts of a higher alcohol (average number of carbon atoms: n=15) and the azo iron complex compound (1) was replaced with 2 parts of azo iron complex compound (3). Then, 100 parts of the toner particles obtained were mixed with 1.0 part of negatively chargeable hydrophobic fine silica powder by means of a Henschel mixer to obtain a magnetic toner.

EXAMPLE 7

Toner particles having a weight average particle diameter of 8.5 μm and a volume average particle diameter of 7.9 μm and containing 10% by number of the particles of 3.17 μm or smaller were obtained in the same manner as in Example 1 except that the magnetic iron oxide A was replaced with 100.8 parts of magnetic iron oxide G obtained by surface-treating 100 parts of the magnetic iron oxide of Preparation Example 4 with 0.8 part of a higher alcohol (average number of carbon atoms: n=30) and the azo iron complex compound (1) was replaced with 2 parts of azo iron complex compound (4). Then, 100 parts of the toner particles obtained were mixed with 1.0 part of negatively chargeable hydrophobic fine silica powder by means of a Henschel mixer to obtain a magnetic toner.

EXAMPLE 8

Toner particles having a weight average particle diameter of 6.3 μm and a volume average particle diameter of 5.8 μm and containing 17% by number of the particles of 3.17 μm or smaller were obtained in the same manner as in Example 1 except that the magnetic iron oxide A was replaced with 101 parts of magnetic iron oxide H obtained by surface-treating 100 parts of the magnetic iron oxide of Preparation Example 4 with 1 part of dodecyl alcohol (average number of carbon atoms: n=12) and the azo iron complex compound (1) was replaced with 2 parts of azo iron complex compound (5). Then, 100 parts of the toner particles obtained were mixed with 1.0 part of negatively chargeable hydrophobic fine silica powder by means of a Henschel mixer to obtain a magnetic toner.

EXAMPLE 9

Toner particles having a weight average particle diameter of 3.1 μm and a volume average particle diameter of 2.9 μm and containing 46% by number of the particles of 3.17 μm or smaller were obtained in the same manner as in Example 1 except that the magnetic iron oxide A was replaced with 105 parts of magnetic iron oxide I obtained by surface-treating 100 parts of the magnetic iron oxide of Preparation Example 1 with 5 parts of a higher alcohol (average number of carbon atoms: n=170) and the azo iron complex compound (1) was replaced with 2 parts of azo iron complex compound (6). Then, 100 parts of the toner particles obtained were mixed with 1.0 part of negatively chargeable hydrophobic fine silica powder by means of a Henschel mixer to obtain a magnetic toner.

EXAMPLE 10

Toner particles having a weight average particle diameter of 7.6 μm and a volume average particle diameter of 7.0 μm and containing 11% by number of the particles of 3.17 μm or smaller were obtained in the same manner as in Example 1 except that the magnetic iron oxide A was replaced with 102 parts of magnetic iron oxide J obtained by surface-treating 100 parts of the magnetic iron oxide of Preparation Example 5 with 2 parts of a higher alcohol (average number of carbon atoms: n=280), the azo iron complex compound (1) was replaced with 2 parts of a salicylic acid zinc complex compound and the aliphatic alcohol wax was replaced with 4 parts of polyethylene wax (Mw: 1,200). Then, 100 parts of the toner particles obtained were mixed with 1.0 part of negatively chargeable hydrophobic fine silica powder by means of a Henschel mixer to obtain a magnetic toner.

EXAMPLE 11

Toner particles having a weight average particle diameter of 5.7 μm and a volume average particle diameter of 5.2 μm and containing 15% by number of the particles of 3.17 μm or smaller were obtained in the same manner as in Example 1 except that the magnetic iron oxide A was replaced with 100 parts of magnetic iron oxide K obtained by surface-treating 100 parts of the magnetic iron oxide of Preparation Example 1 with 0.6 part of a higher alcohol (average number of carbon atoms: n=30) and 0.4 part of a higher alcohol (average number of carbon atoms: n=50). Then, 100 parts of the toner particles obtained were mixed with 1.0 part of negatively chargeable hydrophobic fine silica powder by means of a Henschel mixer to obtain a magnetic toner.

The magnetic iron oxide K was analyzed by DSC to reveal that it had peak values at 63° C. and 98° C. in the region of from 60° C. to 150° C. of the DSC chart endothermic curve.

COMPARATIVE EXAMPLE 1

| | |
|---|---|
| Magnetic iron oxide L comprised of the magnetic iron oxide of Preparation Example 5 but not surface-treated with any alcohol | 100 parts |
| Salicylic acid zinc complex compound | 2 parts |
| Polyethylene wax (Mw: 8,000) | 4 parts |

Using the above materials and 100 parts of the binder resin as used in Example 1, toner particles having a weight average particle diameter of 12.5 μm and a volume average particle diameter of 10.8 μm and containing 10% by number of the particles of 3.17 μm or smaller were obtained in the same manner as in Example 1. Then, 100 parts of the toner particles obtained were mixed with 1.0 part of negatively chargeable hydrophobic fine silica powder by means of a Henschel mixer to obtain a magnetic toner.

COMPARATIVE EXAMPLE 2

Toner particles having a weight average particle diameter of 6.5 μm and a volume average particle diameter of 6.0 μm and containing 35% by number of the particles of 3.17 μm or smaller were obtained in the same manner as in Comparative Example 1 except that the magnetic iron oxide L was replaced with 100 parts of magnetic iron oxide M comprised of the magnetic iron oxide of Preparation Example 4 but not surface-treated with any alcohol. Then, 100 parts of the toner particles obtained were mixed with 1.0 part of negatively chargeable hydrophobic fine silica powder by means of a Henschel mixer to obtain a magnetic toner.

COMPARATIVE EXAMPLE 3

Toner particles having a weight average particle diameter of 5.5 μm and a volume average particle diameter of 5.0 μm and containing 17% by number of the particles of 3.17 μm or smaller were obtained in the same manner as in Example 1 except that the magnetic iron oxide A was replaced with 100.5 parts of magnetic iron oxide N obtained by surface-treating 100 parts of the magnetic iron oxide of Preparation Example 1 with 0.5 part of a silane coupling agent (γ-methacryloxypropyltrimethoxysilane) and the aliphatic alcohol wax was replaced with 4 parts of polypropylene wax (Mw: 8,000). Then, 100 parts of the toner particles obtained were mixed with 1.0 part of negatively chargeable hydrophobic fine silica powder by means of a Henschel mixer to obtain a magnetic toner.

COMPARATIVE EXAMPLE 4

Toner particles having a weight average particle diameter of 5.4 μm and a volume average particle diameter of 4.9 μm and containing 22% by number of the particles of 3.17 μm or smaller were obtained in the same manner as in Example 1 except that the magnetic iron oxide A was replaced with 101 parts of magnetic iron oxide O obtained by surface-treating 100 parts of the magnetic iron oxide of Preparation Example 1 with 1 part of stearic acid and the aliphatic alcohol wax was replaced with 4 parts of polypropylene wax (Mw: 8,000). Then, 100 parts of the toner particles obtained were mixed with 1.0 part of negatively chargeable hydrophobic fine silica powder by means of a Henschel mixer to obtain a magnetic toner.

COMPARATIVE EXAMPLE 5

Toner particles having a weight average particle diameter of 6.3 μm and a volume average particle diameter of 5.8 μm and containing 30% by number of the particles of 3.17 μm or smaller were obtained in the same manner as in Example 1 except that the magnetic iron oxide A was replaced with 100 parts of magnetic iron oxide P obtained by surface-treating 100 parts of the magnetic iron oxide of Preparation Example 1 with 7 parts of a higher alcohol (average number of carbon atoms: n=8). Then, 100 parts of the toner particles obtained were mixed with 1.0 part of negatively chargeable hydrophobic fine silica powder by means of a Henschel mixer to obtain a magnetic toner.

COMPARATIVE EXAMPLE 6

Toner particles having a weight average particle diameter of 6.5 μm and a volume average particle diameter of 6.0 μm and containing 32% by number of the particles of 3.17 μm or smaller were obtained in the same manner as in Example 1 except that the magnetic iron oxide A was replaced with 100 parts of magnetic iron oxide q obtained by surface-treating 100 parts of the magnetic iron oxide of Preparation Example 1 with 1 part of a higher alcohol (average number of carbon atoms: n=310). Then, 100 parts of the toner particles obtained were mixed with 1.0 part of negatively chargeable hydrophobic fine silica powder by means of a Henschel mixer to obtain a magnetic toner.

COMPARATIVE EXAMPLE 7

Toner particles having a weight average particle diameter of 14.5 μm and a volume average particle diameter of 12.5 μm and containing 10% by number of the particles of 3.17 μm or smaller were obtained in the same manner as in Example 1 but changing conditions for the pulverization and the classification. Then, 100 parts of the toner particles obtained were mixed with 1.0 part of negatively chargeable hydrophobic fine silica powder by means of a Henschel mixer to obtain a magnetic toner.

The materials used for preparing the magnetic toners of the above Examples and Comparative Examples are summarized in Tables 3A and 3B.

TABLE 3A

| | Magnetic iron oxide | | | Surface treatment | Particle size distribution of magnetic toner | | Contained in magnetic toner particles | |
|---|---|---|---|---|---|---|---|---|
| | Symbol | Preparation Example No. | Si content (%) | Average number of carbon atoms of alcohol (amount) | Wt. av. particle diam. X (μm) | Number of 3.17 μm or smaller particles Y (%) | Wax | Charge control agent |
| Example: | | | | | | | | |
| 1 | A | 1 | 1.5 | n = 50 (1 pbw) | 5.5 | 20 | Higher alcohol Mw = 700 | Azo iron complex compound (1) |
| 2 | B | 1 | 1.5 | n = 20 (1 pbw) | 5.6 | 17 | Higher alcohol Mw = 700 | Azo chromium complex compound |
| 3 | C | 3 | 2.8 | n = 98 (0.5 pbw) | 6.1 | 13 | Polypropylene Mw = 5,000 | Azo iron complex compound (1) |
| 4 | D | 1 | 1.5 | n = 35 (3 pbw) | 4.9 | 5 | Higher alcohol Mw = 700 | Azo iron complex compound (2) |
| 5 | E | 5 | 0 | n = 50 (0.5 pbw) | 5.2 | 25 | Higher alcohol Mw = 700 | Azo iron complex compound (3) |
| 6 | F | 2 | 1.0 | n = 15 (2 pbw) | 4.7 | 30 | Higher alcohol Mw = 700 | Azo iron complex compound (3) |
| 7 | G | 4 | 5.8 | n = 30 (0.8 pbw) | 8.5 | 10 | Higher alcohol Mw = 700 | Azo iron complex compound (4) |
| 8 | H | 4 | 5.8 | n = 12 (1 pbw) | 6.3 | 17 | Higher alcohol Mw = 700 | Azo iron complex compound (5) |
| 9 | I | 1 | 1.5 | n = 170 (5 pbw) | 3.1 | 46 | Higher alcohol Mw = 700 | Azo iron complex compound (6) |

TABLE 3A-continued

| | Magnetic iron oxide | | | Surface treatment | Particle size distribution of magnetic toner | | Contained in magnetic toner particles | |
|---|---|---|---|---|---|---|---|---|
| | Symbol | Preparation Example No. | Si content (%) | Average number of carbon atoms of alcohol (amount) | Wt. av. particle diam. X (μm) | Number of 3.17 μm or smaller particles Y (%) | Wax | Charge control agent |
| 10 | J | 5 | 0 | n = 280 (2 pbw) | 7.6 | 11 | Polyethylene Mw = 1,200 | Salicylic zinc complex compound |
| 11 | K | 1 | 1.5 | n = 50 (0.4 pbw) n = 30 (0.6 pbw) | 5.7 | 15 | Higher alcohol Mw = 700 | Azo iron complex compound (1) |

TABLE 3B

| | Magnetic iron oxide | | | Surface treatment | Particle size distribution of magnetic toner | | Contained in magnetic toner particles | |
|---|---|---|---|---|---|---|---|---|
| | Symbol | Preparation Example No. | Si content (%) | Average number of carbon atoms of alcohol (amount) | Wt. av. particle diam. X (μm) | Number of 3.17 μm or smaller particles Y (%) | Wax | Charge control agent |
| Comparative Example: | | | | | | | | |
| 1 | L | 5 | 0 | No treatment | 12.5 | 10 | Polyethylene Mw = 8,000 | Salicylic zinc complex compound |
| 2 | M | 4 | 5.8 | No treatment | 6.5 | 35 | Polyethylene Mw = 8,000 | Salicylic zinc complex compound |
| 3 | N | 1 | 1.5 | Treated w. silane coupling agent (0.5 pbw) | 5.5 | 17 | Polypropylene Mw = 8,000 | Azo iron complex compound (1) |
| 4 | O | 1 | 1.5 | Treated w. stearic acid (1 pbw) | 5.4 | 22 | Polypropylene Mw = 8,000 | Azo iron complex compound (1) |
| 5 | P | 1 | 1.5 | n = 8 (7 pbw) | 6.3 | 30 | Higher alcohol Mw = 700 | Azo iron complex compound (1) |
| 6 | q | 1 | 1.5 | n = 310 (1 pbw) | 6.0 | 32 | Higher alcohol Mw = 700 | Azo iron complex compound (1) |
| 7 | A | 1 | 1.5 | n = 50 (1 pbw) | 14.5 | 10 | Higher alcohol Mw = 700 | Azo iron complex compound (1) |

Next, performances of the magnetic toners prepared in Examples 1 to 11 and Comparative Examples 1 to 7 shown above were evaluated in the following way.

Figure 3:
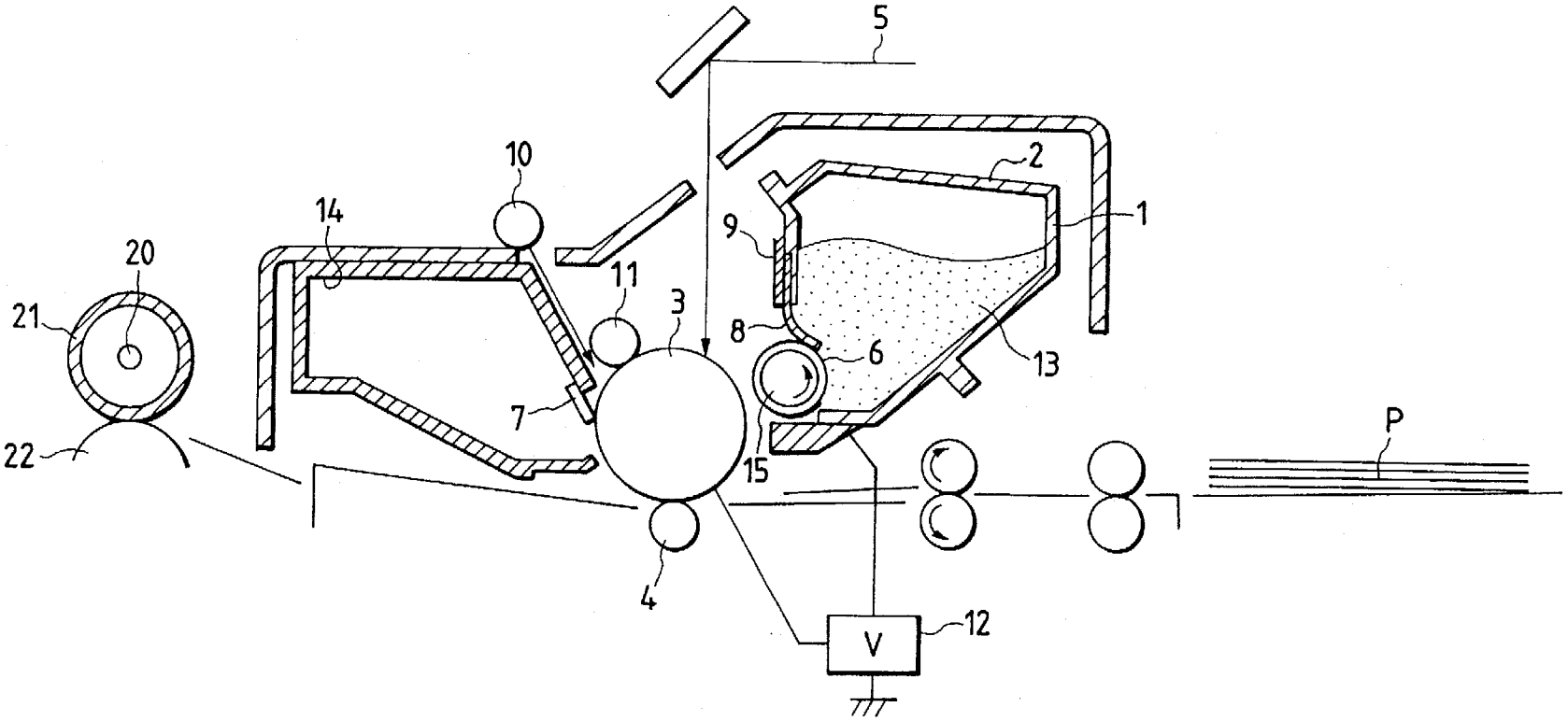
FIG. 3 is a schematic illustration of an image forming apparatus that can carry out the image forming process according to the present invention.

Using a commercially available laser beam printer of the type as shown in FIG. 3, LBP-450 (manufactured by CANON INC.), images were printed out on 20,000 sheets in a low temperature and low humidity environment (10° C., 15% RH) at a printing speed of 12 sheets (A4) per minute. Thereafter, using a cartridge of the same printer, printing was further tested on 30,000 sheets in a high temperature and high humidity environment (32.5° C., 90% RH). When toner was used up, the toner was supplied through a notch which was previously made in the toner container at the top of the cartridge of the printer, and the printing was continued. Images obtained were evaluated in respect of the following items.

(1) Charging member contamination:

After printed out on 50,000 sheets, halftone images and the charging roller were visually observed to make evaluation.

A: No contamination is seen in direct visual observation of the charging member.

B: Contamination is seen in direct visual observation of the charging member, but its marks do not appear on images.

C: Marks of contamination of the charging member appear on images, but are so slight that there is no problem in practical use.

D: Marks of contamination of the charging member appear on images, and are not tolerable for practical use.

(2) Image density:

At the time the printing on 50,000 sheets was completed on usual copying plain paper (75 g/m$^2$), image density was evaluated on how the image density was maintained. The image density was measured using Macbeth Reflection Densitometer (manufactured by Macbeth Co.), and relative density with respect to images printed out on the white background of 0.00 density of an original was measured.

(3) Fogging:

Fogging was calculated by comparing the whiteness of transfer paper, measured using a reflectometer (manufactured by Tokyo Denshoku K.K.), and the whiteness of transfer paper after print of solid white after images were printed out on 20,000 sheets in a low temperature and low humidity environment.

(4) Image quality:

Sharpness: A Chinese character "[illegible]" of about 2 mm square was printed out, and any toner scattering around characters was examined by microscopic observation to evaluate the level of sharpness of characters.

A: Characters are almost free from toner scattering around them, and sharp.

B: A little much toner scattering is seen.

C: Very much toner scattering is seen.

Dot reproducibility: A pattern of individually independent dots was printed out to evaluate the reproducibility of each dot by microscopic observation.

A: Dots are faithfully reproduced.

B: A little disorder is seen in images.

C: Much disorder is seen in images, showing a poor reproducibility.

(5) Fixing performance:

Fixing performance was evaluated as a rate (%) of decrease in image density of fixed images before and after they were rubbed with soft thin paper under a load of 50 g/cm$^2$.

A: 0 to 10% (good)

B: 10 to 20% (passable)

C: More than 20% (failure)

(6) Anti-offset properties:

Sample images with an image area of about 5% were printed out, and anti-offset properties were evaluated according to the degree of stain on images after printing on 5,000 sheets.

A: Good (almost not occur).

B: Tolerable for practical use.

C: Not tolerable for practical use.

The results of evaluation on the above items (1) to (6) are shown in Table 4.

TABLE 4

| | (1) Charging member contamination | (2) Image density | (3) Fogging (%) | (4) Image quality: Sharpness | (4) Image quality: Dot reproducibility | (5) Fixing performance | (6) Anti-offset properties |
|---|---|---|---|---|---|---|---|
| Example: | | | | | | | |
| 1 | A | 1.45 | 0.8 | A | A | A | A |
| 2 | A | 1.37 | 1.2 | A | A | A | A |
| 3 | A | 1.43 | 0.6 | A | A | B | B |
| 4 | A | 1.44 | 0.8 | A | B | A | A |
| 5 | A | 1.40 | 2.0 | A | A | A | A |
| 6 | B | 1.42 | 1.0 | A | A | A | A |
| 7 | A | 1.35 | 0.9 | B | B | A | A |
| 8 | B | 1.30 | 1.1 | A | A | A | A |
| 9 | B | 1.22 | 2.6 | A | A | A | A |
| 10 | B | 1.34 | 1.9 | B | B | A | B |
| 11 | A | 1.46 | 0.6 | A | A | A | A |
| Comparative Example: | | | | | | | |
| 1 | C | 1.33 | 3.4 | C | B | C | B |
| 2 | D | 1.26 | 5.7 | A | A | C | B |
| 3 | D | 1.22 | 4.3 | A | A | C | B |
| 4 | D | 1.20 | 5.0 | A | A | C | B |
| 5 | C | 1.23 | 4.1 | B | B | A | C |
| 6 | D | 1.31 | 4.5 | B | A | C | B |
| 7 | B | 1.32 | 3.1 | C | C | A | A |

Next, performances of only the magnetic toners prepared in Examples 1 and 11 were evaluated in the following way.

Using a commercially available laser beam printer of the type as shown in FIG. 3, LBP-450 (Manufactured by CANON INC.), images were printed out on 20,000 sheets in a low temperature and low humidity environment (10° C., 15% RH); the printer being modified so as to drive at a printing speed of 18 sheets (A4) per minute. Thereafter, using a cartridge of the same printer, printing was further tested on 30,000 sheets in a high temperature and high humidity environment (32.5° C., 90% RH). When toner was used up, the toner was supplied through a notch which was previously made in the toner container at the top of a cartridge of the printer, and the printing was continued. Images obtained were evaluated in respect of the items (1) to (6) previously stated.

The results of evaluation are shown in Table 5.

TABLE 5

| | (1) Charging member contamination | (2) Image density | (3) Fogging (%) | (4) Image quality Sharpness | Dot reproducibility | (5) Fixing performance | (6) Anti-offset properties |
|---|---|---|---|---|---|---|---|
| Example: | | | | | | | |
| 1 | B | 1.43 | 1.3 | A | A | A | A |
| 11 | A | 1.45 | 0.8 | A | A | A | A |

Magnetic Iron Oxide Particles

Preparation Example 6

In an aqueous ferrous sulfate solution, sodium silicate was added so as to be in a content of 1.5% as silicon element on the basis of iron element, and thereafter a sodium hydroxide solution of from 1.0 to 1.1 in equivalent weight on the basis of iron ions was mixed, thus an aqueous solution containing ferrous hydroxide was prepared.

Into the aqueous solution, air was blown while maintaining its pH to from 7 to 10 (e.g., pH 9), and oxidation reaction was carried out at from 80° C. to 90° C., thus a slurry for forming seed crystals was prepared.

Next, to this slurry, the aqueous ferrous sulfate solution was added so as to be in an equivalent weight of from 0.9 to 1.2 on the basis of the initial alkali weight (sodium component of the sodium silicate and sodium component of the sodium hydroxide). Thereafter, the oxidation reaction was allowed to proceed while maintaining the pH of the slurry to from 6 to 10 (e.g., pH 8) and while blowing air into it. At the termination of the oxidation reaction, the pH was adjusted to localize the silicic acid component to the surfaces of the magnetic iron oxide particles. The magnetic iron oxide particles thus formed were washed, filtered and dried by conventional methods, followed by disintegration of particles agglomerating, to obtain a magnetic iron oxide having the characteristics as shown in Table 6.

In the magnetic iron oxide obtained in Preparation Example 6, the particles had a number average particle diameter of 0.16 μm and a cumulative number of 73%, the content C of silicon element originating from the silicon compound such as silicic acid dissolved by the alkali, present on the surfaces of the magnetic iron oxide particles, was 14.9 mg/l, and the content B of silicon element originating from the silicon compound present in the surface portions of the magnetic iron oxide particles was 32.3 mg/l. Total content A of silicon element was 49.8 mg/l.

$(B/A)\times100=64.86\%$, $(C/A)\times100=29.92\%$

Magnetic Iron Oxide Particles

Preparation Example 7

A magnetic iron oxide having the characteristics as shown in Table 6 was obtained in the same manner as in Preparation Example 6 except that the sodium silicate was added so as to be in a content of 1.0% as silicon element on the basis of iron element.

Magnetic Iron Oxide Particles

Preparation Example 8

A magnetic iron oxide having the characteristics as shown in Table 6 was obtained in the same manner as in Preparation Example 6 except that the sodium silicate was added so as to be in a content of 2.8% as silicon element on the basis of iron element.

Magnetic Iron Oxide Particles

Preparation Example 9

A magnetic iron oxide having the characteristics as shown in Table 6 was obtained in the same manner as in Preparation Example 6 except that the sodium silicate was not added.

Magnetic Iron Oxide Particles

Preparation Example 10

In an aqueous ferrous sulfate solution, sodium silicate was added so as to be in a content of 0.4% as silicon element on the basis of iron element, and thereafter a sodium hydroxide solution of 0.97 in equivalent weight on the basis of iron ions was mixed, thus an aqueous solution containing ferrous hydroxide was prepared at 90° C. while maintaining the pH of the aqueous solution to pH 6.9.

Into the aqueous solution, air was blown at 90° C. while maintaining its pH at 6.9, thus an aqueous solution containing magnetite was prepared.

Next, the magnetic iron oxide particles thus formed were washed, filtered and dried by conventional methods, followed by disintegration of particles agglomerating, to obtain magnetic iron oxide particles having the characteristics as shown in Table 6.

In the magnetic iron oxide particles obtained in Preparation Example 10, the particles had a number average particle diameter of 0.18 μm and a cumulative number of 70%, the content C of silicon element originating from the silicon compound such as silicic acid dissolved by the alkali, present on the surfaces of the magnetic iron oxide particles, was 0.03 mg/l, and the content B of silicon element originating from the silicon compound present in the surface portions of the magnetic iron oxide particles was 0.02 mg/l. The total silicon content A was 47.9 mg/l.

$(B/A)\times100=0.04\%$, $(C/A)\times100=0.06\%$

TABLE 6

Physical Properties of Magnetic Material Particles

| Preparation Example: | Number average particle diameter (μm) | 0.10 μm to 0.20 μm cumulative number (%) | Silicon content (%) |
|---|---|---|---|
| 6 | 0.16 | 73 | 1.5 |
| 7 | 0.28 | 50 | 1.0 |
| 8 | 0.08 | 81 | 2.8 |
| 9 | 0.42 | 35 | 0.0 |
| 10 | 0.18 | 70 | 0.3 |

100 parts of the magnetic iron oxide particles thus obtained were surface-treated with a stated amount of wax A, or wax A and wax B, as shown in Table 7, by dry-process mixing them in a Henschel mixer. Thus, wax-treated magnetic iron oxide particles r to Y were obtained.

TABLE 7

| Magnetic iron oxide | Prep. Example No. | Coating wax A Mn | Mw/Mn | (1) | (2) | (3) | Coating wax B Mn | Mw/Mn | (1) | (2) | (3) | Number of DSC chart peak values (peak temp.) | Coating wax (3) |
|---|---|---|---|---|---|---|---|---|---|---|---|---|---|
| r | 6 | 750 | 1.8 | 55 | OH | 1.8 | 752 | 1.7 | 56 | — | 0.4 | 2 (105° C., 113° C.) | ALC + PE (2.2) |
| S | 7 | 700 | 1.7 | 50 | OH | 1.5 | 755 | 1.6 | 58 | OH | 0.5 | 2 (100° C., 120° C.) | ALC × 2 (2.0) |
| T | 6 | 750 | 1.8 | 55 | OH | 0.04 | 752 | 1.7 | 56 | — | 0.01 | 2 (105° C., 113° C.) | ALC + PE (0.05) |
| U | 6 | 750 | 1.8 | 55 | OH | 14 | 752 | 1.7 | 56 | — | 3.0 | 2 (105° C., 113° C.) | ALC + PE (17.0) |
| V | 8 | 160 | 2.4 | 18 | OH | 1.2 | 755 | 1.8 | 58 | OH | 0.5 | 2 (70° C, 120° C.) | ALC × 2 (1.7) |
| W | 10 | 750 | 1.8 | 55 | OH | 1.8 | 752 | 1.7 | 56 | — | 0.4 | 2 (105° C., 113° C.) | ALC + PE (2.2) |
| X | 9 | — | — | — | — | — | — | — | — | — | — | — | None |
| Y | 9 | 5,900 | 5.7 | 440 | — | 6.0 | — | — | — | — | — | 1 (160° C.) | PP (6.0) |

(1): Average number of carbon atoms
(2): Functional group
(3): Amount of wax used in treatment (pbw)
ALC: Aliphatic alcohol
PE: Polyethylene wax
PP: Polypropylene wax Physical properties of the waxes incorporated (internally added) in the magnetic iron oxide particles of the magnetic toners to be produced in the following Examples 12 to 18 and Comparative Examples 8 to 10 are shown in Table 8 below.

TABLE 8

| Wax | Y*4 | x*5 | Mn*6 | Mw*7 | Mw/Mn*8 |
|---|---|---|---|---|---|
| W-1 | OH | 55 | 480 | 890 | 1.9 |
| W-2 | OH | 210 | 1,880 | 3,500 | 1.9 |
| W-3 | OH | 35 | 220 | 750 | 3.4 |
| W-4 | OH | 260 | 2,320 | 4,400 | 1.9 |
| W-5 | COOH | 41 | 390 | 840 | 3.6 |
| W-6 | $OC(CH_3)3$ | 53 | 740 | 1,080 | 1.5 |

*4, *5: $CH_3(CH_2)_xY$,
x: average value

TABLE 8-continued

| Wax | Y*4 | x*5 | Mn*6 | Mw*7 | Mw/Mn*8 |
|---|---|---|---|---|---|

Y: functional group
*6: Mn is number average molecular weight.
*7: Mw is weight average molecular weight.
*8: Mw/Mn is a value of weight average molecular weight/number average molecular weight.

EXAMPLE 12

| | |
|---|---|
| Styrene/butyl acrylate/monobutyl maleate copolymer (copolymerization ratio: 75/20/5) | 100 parts |
| Surface-treated magnetic iron oxide r | 102 parts |
| Low-molecular weight wax (Table 8, W-1) | 5 parts |
| Charge control agent, azo iron complex compound (1) | 2 parts |

A mixture of the above materials was melt-kneaded using a twin-screw extruder heated to 130° C. The resulting kneaded product was cooled, and then crushed using a hammer mill. The crushed product was finely pulverized using a jet mill. The finely pulverized product obtained was classified using a fixed-wall type air classifier to produce a classified powder. The classified powder obtained was further put in a multi-division classifier utilizing the Coanda effect (Elbow Jet Classifier, manufactured by Nittetsu Kogyo Co.) to strictly classify and remove ultrafine powder and coarse powder at the same time. Thus, negatively chargeable magnetic toner particles with a weight average particle diameter (D4) of 5.5 μm (content of magnetic toner particles with a particle diameter of 10.1 μm: 0.1%) was obtained.

Next, 100 parts by weight of the magnetic toner particles thus obtained and 1.5 parts by weight of oil-treated silica were added and mixed in a Henschel mixer to obtain a magnetic toner as shown in Table 9.

EXAMPLES 13 TO 18, COMPARATIVE EXAMPLES 8 TO 10

Magnetic toners as shown in Table 9 were obtained in the same manner as in Example 12 but changing the magnetic iron oxide particles, the wax, the charge control agent and the amount of external addition as also shown in Table 9.

TABLE 9

| | Formulation of internal addition | | | | Particle size distribution of magnetic toner | | |
|---|---|---|---|---|---|---|---|
| | Magnetic iron oxide particles (content) (pbw) | Wax (content) (pbw) | Charge control agent (content) (pbw) | Binder resin (content) (pbw) | Wt. av. particle diam. X (μm) | Number of 3.17 μm or smaller particles Y (%) | Formulation of external addition (amount) (wt. %) |
| Example: | | | | | | | |
| 12 | r (102.2) | W-1 (4) | Azo iron complex compound (1) (2) | St-Ac (100) | 5.5 | 12.3 | HPB silica (1.5) |
| 13 | S (102) | W-2 (3) | Azo iron complex compound (1) (2) | St-Ac (100) | 6.3 | 10.1 | HPB silica (1.5) |
| 14 | T (100.05) | W-3 (6) | Azo iron complex compound (1) (2) | St-Ac (100) | 4.6 | 18.5 | HPB silica (2.0) |
| 15 | U (117) | None | Azo iron complex compound (1) (2) | St-Ac (100) | 5.8 | 12.2 | HPB silica (1.5) |
| 16 | V (101.7) | W-4 (9) | Azo iron complex compound (1) (2) | St-Ac (100) | 5.8 | 12.6 | HPB silica (1.5) |
| 17 | S (103) | W-6 (5) | Azo iron complex compound (1) (1) | St-Ac (100) | 6.9 | 8.9 | HPB silica (1.2) |
| 18 | W (101) | W-1 (4) | Azo iron complex compound (1) (2) | St-Ac (100) | 5.5 | 13.8 | HPB silica (1.5) |
| Comparative Example: | | | | | | | |
| 8 | X (100) | W-5 (7) | Naphthoic iron complex compound of Formula (4) (2) | St-Ac (100) | 8.8 | 5.7 | HPB silica (0.8) |
| 9 | Y (106) | W-4 (1) | Azo iron complex compound (1) (2) | St-Ac (100) | 10.5 | 4.6 | HPB silica (0.8) |
| 10 | X (100) | W-6 (15) | Azo iron complex compound (1) (2) | St-Ac (100) | 12.0 | 3.3 | HPB silica (0.8) |

HPB silica: Hydrophobic fine silica particles

Next, performances of the magnetic toners prepared in Examples 12 to 18 and Comparative Examples 8 to 10 shown above were evaluated in the following way.

As an electrophotographic apparatus, a commercially available laser beam printer LBP-A309 GII, manufactured by CANON INC. and in which as shown in FIG. 3 the photosensitive member 3 is charged by means of the charging roller 11, was used after it was modified so as to have a higher printing speed of 1.5 times (24 sheets per minute, A4). As a cartridge, an EP-B cartridge, manufactured by CANON INC., was modified to have a structure enabling the supply of toner. Printing was continuously tested on 30,000 sheets in a high temperature and high humidity environment (32.5°C., 90% RH) or a low temperature and low humidity environment (10° C., 15% RH) while supplying the magnetic toner. To examine how were the contamination of the charging roller, the developing sleeve, the toner layer thickness control blade and so forth, the melt-adhesion of toner to the photosensitive member and the images obtained, evaluation was made in respect of the following items.

(7) Image density:

At the time the printing on 20,000 sheets was completed on usual copying plain paper (75 g/m$^2$), image density was evaluated on how the image density was maintained. The image density was measured using Macbeth Reflection Densitometer (manufactured by Macbeth Co.), and relative density with respect to images printed out on the white background of 0.00 density of an original was measured.

(8) Fogging:

Fogging was calculated by comparing the whiteness of transfer paper, measured using a reflectometer (manufactured by Tokyo Denshoku K.K.), and the whiteness of transfer paper after print of solid white.

(9) Image quality:

Sharpness: A Chinese character "[illegible]" of about 2 mm square was printed out, and any toner scattering around characters was examined by observation using an optical microscope to evaluate the level of sharpness of characters.

A: Characters are almost free from toner scattering around them, and sharp.

B: A little much toner scattering is seen.

C: Much toner scattering is seen.

Dot reproducibility: A pattern of individually independent dots was printed out to evaluate the reproducibility of each dot by observation using an optical microscope.

A: Dots are faithfully reproduced.

B: A little disorder is seen in images.

C: Much disorder is seen in images, showing a poor reproducibility.

(10) Charging member contamination:

After the printing test was completed, halftone images and the charging roller were visually observed to make evaluation.

A: No contamination is seen in direct visual observation of the charging member.

B: Contamination is seen in direct visual observation of the charging member, but its marks do not appear on images.

C: Marks of contamination of the charging member appear on images, but are slight.

D: Marks of contamination of the charging member appear on images.

(11) Developing sleeve contamination:

After the printing test was completed, halftone images and any scratches or toner contamination on the developing sleeve were visually observed to make evaluation.

A: Very good (not occur).

B: Good (almost not occur).

C: Substantially good (contamination occurs but not so affects the images formed.

D: Poor (much contamination occurs to cause uneven images).

(12) Control blade contamination:

After the printing test was completed, halftone images and any scratches or toner contamination on the toner layer thickness control blade were visually observed to make evaluation.

A: Very good (not occur).

B: Good (almost not occur).

C: Substantially good (melt-adhesion of toner occurs but not so affects the images formed.

D: Poor (faulty images).

(13) Melt-adhesion to photosensitive member:

How scratches and melt-adhesion of residual toner occurred on the surface of the photosensitive member and how they affected the images printed out were visually examined to make evaluation.

A: Very good (not occur).

B: Good (melt-adhesion of toner to the surface of the photosensitive member is seen at less than 5 spots, not affecting the images formed).

C: Substantially good (melt-adhesion of toner to the surface of the photosensitive member is seen at 5 spots or more to less than 10 spots, not so affecting the images formed).

D: Poor (melt-adhesion of toner to the surface of the photosensitive member is seen 10 spots or more, causing faulty images).

(14) Fixing performance:

Fixing performance was evaluated as a rate (%) of decrease in image density of fixed images before and after they were rubbed with soft thin paper under a load of 50 g/cm$^2$.

A: less than 5% (excellent)

B: 5% or more to less than 10% (good)

C: 10% or more to less than 20% (a little good)

D: Not less than 20% (poor)

(15) Anti-offset properties:

Sample images with an image area of about 5% were printed out, and anti-offset properties were evaluated according to the degree of stain on images after printing on 20,000 sheets.

A: Very good (no offset).

B: Good (almost no offset).

C: Substantially good.

D: Poor.

The results of evaluation on the above items (7) to (15) are shown in Table 10.

TABLE 10

| | High temp./high humidity environment (32. 5° C./90% RH) | | | | | | | | Low temp./ low humidity environment (10° C./15% RH) | | | |
|---|---|---|---|---|---|---|---|---|---|---|---|---|
| | (9) Image quality | | | | | | | | (7) | | | |
| | (7) Image density | | | Dot | | | | | Image density | (8) Fogging | (14) Fixing | (15) |
| | Initial | 20,000 sheets | Sharp-ness | reproduc-ibility | (10)* | (11)* | (12)* | (13)* | 20,000 sheets | 20,000 sheets | perfom-ance | Anti-offset |
| Example: | | | | | | | | | | | | |
| 12 | 1.45 | 1.46 | A | A | A | A | A | A | 1.48 | 1.2 | B | B |
| 13 | 1.42 | 1.41 | A | A | A | B | B | B | 1.41 | 1.8 | C | A |
| 14 | 1.41 | 1.43 | A | A | A | B | B | C | 1.40 | 1.9 | C | B |
| 15 | 1.42 | 1.41 | A | B | A | C | C | B | 1.40 | 2.5 | B | B |
| 16 | 1.41 | 1.40 | B | A | A | C | C | B | 1.42 | 3.3 | B | C |
| 17 | 1.33 | 1.38 | B | B | A | C | C | C | 1.35 | 2.8 | C | B |
| 18 | 1.45 | 1.44 | A | B | A | A | A | A | 1.46 | 2.3 | B | B |
| Comparative Example: | | | | | | | | | | | | |
| 8 | 1.31 | 1.12 | C | C | D | D | D | C | 1.33 | 4.5 | C | C |
| 9 | 0.98 | 0.85 | C | C | D | D | D | D | 1.21 | 5.3 | D | D |
| 10 | 1.45 | 1.32 | C | C | C | D | D | D | 1.01 | 4.2 | B | D |

*as shown in the specification

What is claimed is:

1. A magnetic toner for developing an electrostatic image, comprising magnetic toner particles containing at least a binder resin and magnetic iron oxide particles, wherein;

said magnetic iron oxide particles have been surface-treated with an aliphatic alcohol having carbon atoms of from 12 to 300 on the average; and said magnetic toner has a weight average particle diameter of 13.5 μm or smaller, and contains magnetic toner particles with particle diameters of 3.17 μm or smaller in an amount not less than 1% by number as number-based percentage determined from number distribution.

2. The magnetic toner according to claim 1, wherein said aliphatic alcohol has carbon atoms of from 12 to 100 on the average.

3. The magnetic toner according to claim 1, wherein said aliphatic alcohol has carbon atoms of from 20 to 100 on the average.

4. The magnetic toner according to claim 1, wherein said magnetic iron oxide particles have been surface-treated with said aliphatic alcohol, used in an amount of from 0.05 part by weight to 15 parts by weight based on 100 parts by weight of the magnetic iron oxide particles.

5. The magnetic toner according to claim 1, wherein said magnetic iron oxide particles have been surface-treated with a wax having at least the aliphatic alcohol having carbon atoms of from 12 to 300 on the average, and the wax has at least two peak values in a DSC chart endothermic curve in its region of temperatures of from 60° C. to 150° C.

6. The magnetic toner according to claim 5, wherein said wax contains said aliphatic alcohol having carbon atoms of from 12 to 300 on the average in an amount of from 50% by weight to 100 % by weight.

7. The magnetic toner according to claim 5, wherein said magnetic iron oxide particles have been surface-treated with said wax, used in an amount of from 0.2 part by weight to 15 parts by weight based on 100 parts by weight of the magnetic iron oxide particles.

8. The magnetic toner according to claim 5, wherein said wax comprises a mixture of the aliphatic alcohol having carbon atoms of from 12 to 300 on the average and a polyethylene wax or a polyethylene derivative wax.

9. The magnetic toner according to claim 1, wherein said magnetic iron oxide particles contain silicon element.

10. The magnetic toner according to claim 9, wherein said magnetic iron oxide particles have the silicon element at least at their particle surfaces.

11. The magnetic toner according to claim 9, wherein said magnetic iron oxide particles contain the silicon element in an amount of from 0.5% by weight to 4% by weight on the basis of iron element.

12. The magnetic toner according to claim 10, wherein the ratio of content B of the silicon element present when the magnetic iron oxide particles have an iron element dissolution of up to 20% by weight to total content A of the silicon element of the magnetic iron oxide particles, (B/A)×100, is from 44% to 84% and the ratio of content C of the silicon element present on the surfaces of the magnetic iron oxide particles to total content A of the silicon element of the magnetic iron oxide particles, (C/A)×100, is from 10% to 55%.

13. The magnetic toner according to claim 9, wherein said magnetic iron oxide particles contain the silicon element in an amount of from 0.5% by weight to 4% by weight on the basis of iron element, where the ratio of content B of the silicon element present when the magnetic iron oxide particles have an iron element dissolution of up to 20% by weight to total content A of the silicon element of the magnetic iron oxide particles, (B/A)×100, is from 44% to 84% and the ratio of content C of the silicon element present on the surfaces of the magnetic iron oxide particles to total content A of the silicon element of the magnetic iron oxide particles, (C/A)×100, is from 10% to 55%.

14. The magnetic toner according to claim 1, wherein said magnetic iron oxide particles have a number average particle diameter of from 0.05 μm to 0.40 μm.

15. The magnetic toner according to claim 1, wherein said magnetic iron oxide particles have a number average particle diameter of from 0.10 μm to 0.40 μm.

16. The magnetic toner according to claim 1, wherein said magnetic iron oxide particles are contained in said magnetic toner particles in an amount of from 20 parts by weight to 200 parts by weight based on 100 parts by weight of the binder resin.

17. The magnetic toner according to claim 1, which has a particle size distribution that fulfills the following conditions where weight average particle diameter (D4) is represented by X (μm) and number-based percentage of the magnetic toner particles with particle diameters of 3.17 μm or smaller as determined from number distribution is represented by Y (% by number):

$$-5X+35 \leqq Y \leqq -25X+180,\ 3.5 \leqq X \leqq 6.5$$

18. The magnetic toner according to claim 1, which has a volume average particle diameter of from 2.5 μm to 6.0 μm.

19. The magnetic toner according to claim 1, wherein said magnetic toner particles contain a low-molecular weight wax represented by the formula:

$$R—Y$$

wherein R represents a hydrocarbon group, and Y is a hydroxyl group, a carboxyl group, an alkyl ether group, an ester group or a sulfonyl group; and the low-molecular weight wax has a weight average molecular weight Mw of not more than 3,000 as measured by gel permeation chromatography.

20. The magnetic toner according to claim 19, wherein said low-molecular weight wax contains as a main component a high-molecular weight alcohol represented by the formula:

$$CH_3(CH_2)_nCH_2OH$$

wherein n represents an average value, and is from 20 to 300.

21. The magnetic toner according to claim 1, wherein said magnetic toner particles contain an azo metal complex represented by the following Formula (1) or a basic organic acid metal complex represented by the following Formula (2):

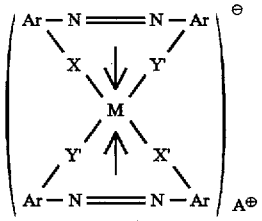

(1)

wherein M represents a central metal of coordination; Ar is an aryl group or an aryl group having a substituent selected from the group consisting of a nitro group, a halogen atom, a carboxyl group, an anilido group, an alkyl group having 1 to 18 carbon atoms and an alkoxyl group having 1 to 18 carbon atoms; X, X', Y and Y' each is —O—, —CO—, —NH— or —NR—, where R is an alkyl group having 1 to 4 carbon atoms; and $A^+$ represents a hydrogen ion, a sodium ion, a potassium ion, an ammonium ion or an aliphatic ammonium ion

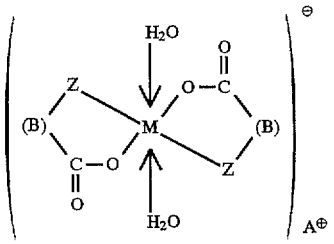

(2)

wherein M represents a central metal of coordination; B is;

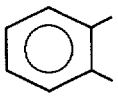

which may have an alkyl group as a substituent

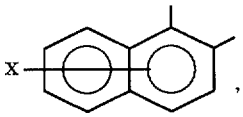

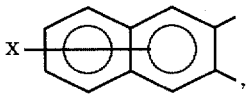

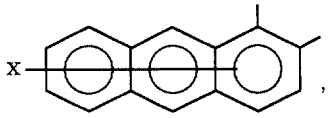

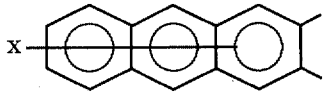

where X is a hydrogen atom, a halogen atom or a nitro group, or

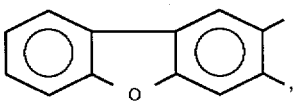

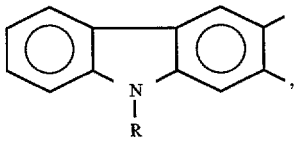

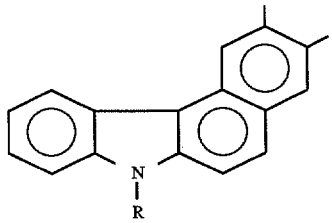

where R is a hydrogen atom, an alkyl group having 1 to 18 carbon atoms or an alkenyl group having 2 to 18 carbon atoms;

$A^+$ represents a hydrogen ion, a sodium ion, a potassium ion, an ammonium ion or an aliphatic ammonium ion; and Z represents —O— or

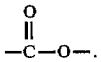

22. The magnetic toner according to claim 1, wherein said magnetic toner particles contain an azo iron complex represented by the following Formula (3):

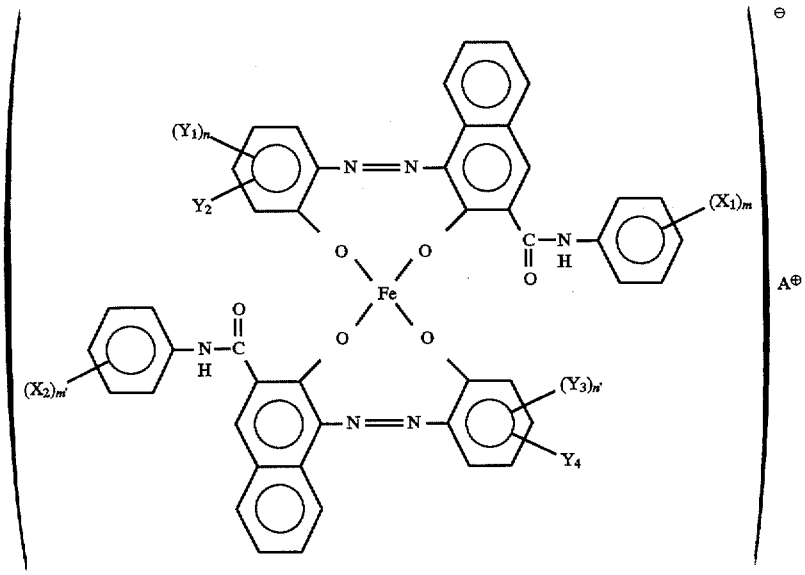

(3)

wherein $X_1$ and $X_2$ each represent a member selected from the group consisting of a hydrogen atom, a lower alkyl group, a lower alkoxyl group, a nitro group and a halogen atom, and m and m' each represent an integer of 1 to 3; $Y_1$ and $Y_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group and a halogen atom, and n and n' each represent an integer of 1 to 3; $Y_2$ and $Y_4$ each are a hydrogen atom or a nitro group; provided that the above $X_1$ and $X_2$, m and m', $Y_1$ and $Y_3$, n and n', and $Y_2$ and $Y_4$ may be the same or different; and $A^+$ represents an ion selected from the group consisting of an ammonium ion, an alkali metal ion, a hydrogen ion or a mixed ion of any of these.

23. The magnetic toner according to claim 1, which comprises said magnetic toner particles and an inorganic fine powder.

24. The magnetic toner according to claim 23, wherein said inorganic fine powder is hydrophobic.

25. An image forming process comprising the steps of;

bringing a charging member to which a voltage is externally applied, into contact with a latent image bearing member to electrostatically charge the latent image bearing member;

forming an electrostatic latent image on the latent image bearing member thus charged, by an electrostatic latent image forming means; and developing the electrostatic latent image formed on the latent image bearing member, by the use of a magnetic toner held by a developing means, to form a toner image;

wherein;

said magnetic toner comprises magnetic toner particles containing at least a binder resin and magnetic iron oxide particles;

said magnetic iron oxide particles have been surface-treated with an aliphatic alcohol having carbon atoms of from 12 to 300 on the average; and said magnetic toner has a weight average particle diameter of 13.5 μm or smaller, and contains magnetic toner particles with particle diameters of 3.17 μm or smaller in an amount not less than 1% by number as number-based percentage determined from number distribution.

26. The process according to claim 25, wherein said latent image bearing member comprises an electrophotographic photosensitive member.

27. The process according to claim 26, wherein said electrophotographic photosensitive member comprises an organic photoconductive material.

28. The process according to claim 25, wherein said charging member comprises a roller-like charging member coming into touch with the surface of said latent image bearing member.

29. The process according to claim 25, wherein said charging member comprises a blade-like charging member coming into touch with the surface of said latent image bearing member.

30. The process according to claim 25, wherein said developing means comprises a developing assembly having at least said magnetic toner, a toner container holding said magnetic toner, and a developing sleeve for carrying and transporting the magnetic toner held in the toner container.

31. The process according to claim 30, wherein said developing sleeve transports said magnetic toner held in said toner container, to the developing zone which is a position at which said latent image bearing member and said developing sleeve face each other and a zone in which the electrostatic latent image held on said latent image bearing member is developed by the use of said magnetic toner carried on said developing sleeve.

32. The process according to claim 25, wherein said aliphatic alcohol has carbon atoms of from 12 to 100 on the average.

33. The process according to claim 25, wherein said aliphatic alcohol has carbon atoms of from 20 to 100 on the average.

34. The process according to claim 25, wherein said magnetic iron oxide particles have been surface-treated with said aliphatic alcohol, used in an amount of from 0.05 part by weight to 15 parts by weight based on 100 parts by weight of the magnetic iron oxide particles.

35. The process according to claim 25, wherein said magnetic iron oxide particles have been surface-treated with a wax having at least the aliphatic alcohol having carbon atoms of from 12 to 300 on the average, and the wax has at least two peak values in a DSC chart endothermic curve in its region of temperatures of from 60° C. to 150° C.

36. The process according to claim 35, wherein said wax contains said aliphatic alcohol having carbon atoms of from 12 to 300 on the average in an amount of from 50% by weight to 100 % by weight.

37. The process according to claim 35, wherein said magnetic iron oxide particles have been surface-treated with said wax, used in an amount of from 0.2 part by weight to 15 parts by weight based on 100 parts by weight of the magnetic iron oxide particles.

38. The process according to claim 35, wherein said wax comprises a mixture of the aliphatic alcohol having carbon atoms of from 12 to 300 on the average and a polyethylene wax or a polyethylene derivative wax.

39. The process according to claim 25, wherein said magnetic iron oxide particles have silicon element.

40. The process according to claim 39, wherein said magnetic iron oxide particles have the silicon element at least at their particle surfaces.

41. The process according to claim 39, wherein said magnetic iron oxide particles contain the silicon element in an amount of from 0.5% by weight to 4% by weight on the basis of iron element.

42. The process according to claim 40, wherein the ratio of content B of the silicon element present when the magnetic iron oxide particles have an iron element dissolution of up to 20% by weight to total content A of the silicon element of the magnetic iron oxide particles, (B/A)×100, is from 44% to 84% and the ratio of content C of the silicon element present on the surfaces of the magnetic iron oxide particles to total content A of the silicon element of the magnetic iron oxide particles, (C/A)×100, is from 10% to 55%.

43. The process according to claim 39, wherein said magnetic iron oxide particles contain the silicon element in an amount of from 0.5% by weight to 4% by weight on the basis of iron element, where the ratio of content B of the silicon element present when the magnetic iron oxide particles have an iron element dissolution of up to 20% by weight to total content A of the silicon element of the magnetic iron oxide particles, (B/A)×100, is from 44% to 84% and the ratio of content C of the silicon element present on the surfaces of the magnetic iron oxide particles to total content A of the silicon element of the magnetic iron oxide particles, (C/A)×100, is from 10% to 55%.

44. The process according to claim 25, wherein said magnetic iron oxide particles have a number average particle diameter of from 0.05 μm to 0.40 μm.

45. The process according to claim 25, wherein said magnetic iron oxide particles have a number average particle diameter of from 0.10 μm to 0.40 μm.

46. The process according to claim 25, wherein said magnetic iron oxide particles are contained in said magnetic toner particles in an amount of from 20 parts by weight to 200 parts by weight based on 100 parts by weight of the binder resin.

47. The process according to claim 25, wherein said magnetic toner has a particle size distribution that fulfills the following conditions where weight average particle diameter (D4) is represented by X (μm) and number-based percentage of the magnetic toner particles with particle diameters of 3.17 μm or smaller as determined from number distribution is represented by Y (% by number):

$$-5X+35 \leqq Y \leqq -25X+180,\ 3.5 \leqq X \leqq 6.5$$

48. The process according to claim 25, wherein said magnetic toner has a volume average particle diameter of from 2.5 μm to 6.0 μm.

49. The process according to claim 25, wherein said magnetic toner particles contain a low-molecular weight wax represented by the formula:

$$R—Y$$

wherein R represents a hydrocarbon group, and Y is a hydroxyl group, a carboxyl group, an alkyl ether group, an ester group or a sulfonyl group; and the low-molecular weight wax has a weight average molecular weight Mw of not more than 3,000 as measured by gel permeation chromatography.

50. The process according to claim 49, wherein said low-molecular weight wax contains as a main component a high-molecular weight alcohol represented by the formula:

$$CH_3(CH_2)_nCH_2OH$$

wherein n represents an average value, and is from 20 to 300.

51. The process according to claim 25, wherein said magnetic toner particles contain an azo metal complex represented by the following Formula (1) or a basic organic acid metal complex represented by the following Formula (2):

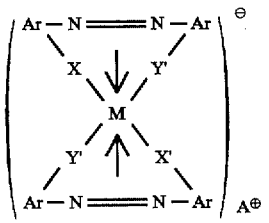

(1)

wherein M represents a central metal of coordination; Ar is an aryl group or an aryl group having a substituent selected from the group consisting of a nitro group, a halogen atom, a carboxyl group, an anilido group, an alkyl group having 1 to 18 carbon atoms and an alkoxyl group having 1 to 18 carbon atoms; X, X', Y and Y' each is —O—, —CO—, —NH— or —NR—, where R is an alkyl group having 1 to 4 carbon atoms; and $A^+$ represents a hydrogen ion, a sodium ion, a potassium ion, an ammonium ion or an aliphatic ammonium ion

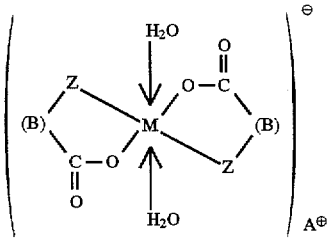

(2)

wherein M represents a central metal of coordination; B represents;

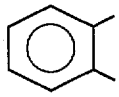

which may have an alkyl group as a substituent

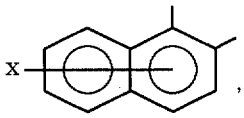

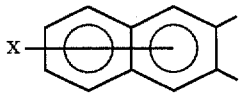

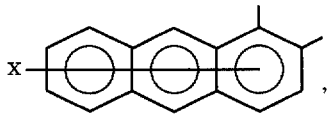

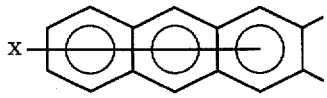

where X is a hydrogen atom, a halogen atom or a nitro group, or

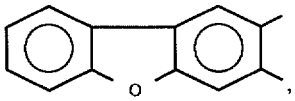

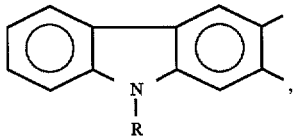

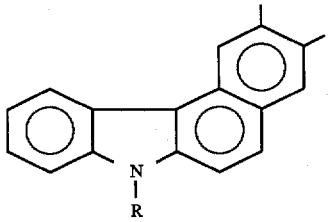

where R is a hydrogen atom, an alkyl group having 1 to 18 carbon atoms or an alkenyl group having 2 to 18 carbon atoms;

$A^+$ represents a hydrogen ion, a sodium ion, a potassium ion, an ammonium ion or an aliphatic ammonium ion; and Z represents —O— or $$-\overset{O}{\overset{\|}{C}}-O-.$$

52. The process according to claim 25, wherein said magnetic toner particles contain an azo iron complex represented by the following Formula (3):

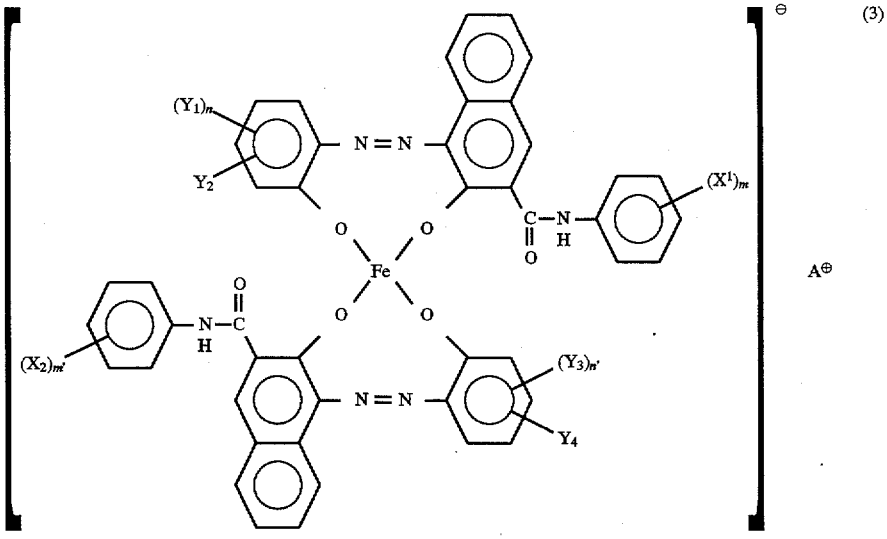

(3)

wherein $X_1$ and $X_2$ each represent a member selected from the group consisting of a hydrogen atom, a lower alkyl group, a lower alkoxyl group, a nitro group and a halogen atom, and m and m' each represent an integer of 1 to 3; $Y_1$ and $Y_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group and a halogen atom, and n and n' each represent an integer of 1 to 3; $Y_2$ and $Y_4$ each are a hydrogen atom or a nitro group; provided that the above $X_1$ and $X_2$, m and m', $Y_1$ and $Y_3$, n and n', and $Y_2$ and $Y_4$ may be the same or different; and $A^+$ represents an ion selected from the group consisting of an ammonium ion, an alkali metal ion, a hydrogen ion or a mixed ion of any of these.

53. The process according to claim 25, wherein said magnetic toner comprises said magnetic toner particles and an inorganic fine powder.

54. The process according to claim 53, wherein said inorganic fine powder is hydrophobic.

55. A process cartridge detachably mountable to a main assembly of an image forming apparatus, comprising;

a latent image bearing member for holding thereon an electrostatic latent image;

a charging member provided in contact with the latent image bearing member, for electrostatically charging the latent image bearing member by externally applying a voltage; and a developing means holding a magnetic toner for developing the electrostatic latent image held on the latent image bearing member, to form a toner image;

wherein;

said magnetic toner comprises magnetic toner particles containing at least a binder resin and magnetic iron oxide particles;

said magnetic iron oxide particles have been surface-treated with an aliphatic alcohol having carbon atoms of from 12 to 300 on the average; and said magnetic toner has a weight average particle diameter of 13.5 μm or smaller, and contains magnetic toner particles with particle diameters of 3.17 μm or smaller in an amount not less than 1% by number as number-based percentage determined from number distribution.

56. The process cartridge according to claim 55, wherein said latent image bearing member comprises an electrophotographic photosensitive member.

57. The process cartridge according to claim 56, wherein said electrophotographic photosensitive member comprises an organic photoconductive material.

58. The process cartridge according to claim 55, wherein said charging member comprises a roller-like charging member coming into touch with the surface of said latent image bearing member.

59. The process cartridge according to claim 55, wherein said charging member comprises a blade-like charging member coming into touch with the surface of said latent image bearing member.

60. The process cartridge according to claim 55, wherein said developing means comprises a developing assembly having at least said magnetic toner, a toner container holding said magnetic toner, and a developing sleeve for carrying and transporting the magnetic toner held in the toner container.

61. The process cartridge according to claim 60, wherein said developing sleeve transports said magnetic toner held in said toner container, to the developing zone which is a position at which said latent image bearing member and said developing sleeve face each other and a zone in which the electrostatic latent image held on said latent image bearing member is developed by the use of said magnetic toner carried on said developing sleeve.

62. The process cartridge according to claim 55, wherein said latent image bearing member, said charging member and said developing means are constituted as one unit, and the unit is detachably mountable to said main assembly.

63. The process cartridge according to claim 55, which comprises said latent image bearing member, said charging member and said developing means, and in addition thereto further comprises a cleaning means.

64. The process cartridge according to claim 55, wherein said aliphatic alcohol has carbon atoms of from 12 to 100 on the average.

65. The process cartridge according to claim 55, wherein said aliphatic alcohol has carbon atoms of from 20 to 100 on the average.

66. The process cartridge according to claim 55, wherein said magnetic iron oxide particles have been surface-treated with said aliphatic alcohol, used in an amount of from 0.05 part by weight to 15 parts by weight based on 100 parts by weight of the magnetic iron oxide particles.

67. The process cartridge according to claim 55, wherein said magnetic iron oxide particles have been surface-treated with a wax having at least the aliphatic alcohol having carbon atoms of from 12 to 300 on the average, and the wax has at least two peak values in a DSC chart endothermic curve in its region of temperatures of from 60° C. to 150° C.

68. The process cartridge according to claim 67, wherein said wax contains said aliphatic alcohol having carbon atoms of from 12 to 300 on the average in an amount of from 50% by weight to 100 % by weight.

69. The process cartridge according to claim 67, wherein said magnetic iron oxide particles have been surface-treated with said wax, used in an amount of from 0.2 part by weight to 15 parts by weight based on 100 parts by weight of the magnetic iron oxide particles.

70. The process cartridge according to claim 67, wherein said wax comprises a mixture of the aliphatic alcohol having carbon atoms of from 12 to 300 on the average and a polyethylene wax or a polyethylene derivative wax.

71. The process cartridge according to claim 55, wherein said magnetic iron oxide particles have silicon element.

72. The process cartridge according to claim 71, wherein said magnetic iron oxide particles have the silicon element at least on their particle surfaces.

73. The process cartridge according to claim 71, wherein said magnetic iron oxide particles contain the silicon element in an amount of from 0.5% by weight to 4% by weight at the basis of iron element.

74. The process cartridge according to claim 72, wherein the ratio of content B of the silicon element present when the magnetic iron oxide particles have an iron element dissolution of up to 20% by weight to total content A of the silicon element of the magnetic iron oxide particles, (B/A)×100, is from 44% to 84% and the ratio of content C of the silicon element present on the surfaces of the magnetic iron oxide particles to total content A of the silicon element of the magnetic iron oxide particles, (C/A)×100, is from 10% to 55%.

75. The process cartridge according to claim 72, wherein said magnetic iron oxide particles contain the silicon element in an amount of from 0.5% by weight to 4% by weight on the basis of iron element, where the ratio of content B of the silicon element present when the magnetic iron oxide particles have an iron element dissolution of up to 20% by weight to total content A of the silicon element of the magnetic iron oxide particles, (B/A)×100, is from 44% to 84% and the ratio of content C of the silicon element present on the surfaces of the magnetic iron oxide particles to total content A of the silicon element of the magnetic iron oxide particles, (C/A)×100, is from 10% to 55%.

76. The process cartridge according to claim 55, wherein said magnetic iron oxide particles have a number average particle diameter of from 0.05 μm to 0.40 μm.

77. The process cartridge according to claim 55, wherein said magnetic iron oxide particles have a number average particle diameter of from 0.10 μm to 0.40 μm.

78. The process cartridge according to claim 55, wherein said magnetic iron oxide particles are contained in said magnetic toner particles in an amount of from 20 parts by weight to 200 parts by weight based on 100 parts by weight of the binder resin.

79. The process cartridge according to claim 55, wherein said magnetic toner has a particle size distribution that fulfills the following conditions where weight average particle diameter (D4) is represented by X (μm) and number-based percentage of the magnetic toner particles with particle diameters of 3.17 μm or smaller as determined from number distribution is represented by Y (% by number):

$$-5X+35 \leqq Y \leqq -25X+180,\ 3.5 \leqq X \leqq 6.5$$

80. The process cartridge according to claim 55, wherein said magnetic toner has a volume average particle diameter of from 2.5 μm to 6.0 μm.

81. The process cartridge according to claim 55, wherein said magnetic toner particles contain a low-molecular weight wax represented by the formula:

$$R—Y$$

wherein R represents a hydrocarbon group, and Y is a hydroxyl group, a carboxyl group, an alkyl ether group, an ester group or a sulfonyl group; and the low-molecular weight wax has a weight average molecular weight Mw of not more than 3,000 as measured by gel permeation chromatography.

82. The process cartridge according to claim 81, wherein said low-molecular weight wax contains as a main component a high-molecular weight alcohol represented by the formula:

$$CH_3(CH_2)_nCH_2OH$$

wherein n represents an average value, and is from 20 to 300.

83. The process cartridge according to claim 55, wherein said magnetic toner particles contain an azo metal complex represented by the following Formula (1) or a basic organic acid metal complex represented by the following Formula (2):

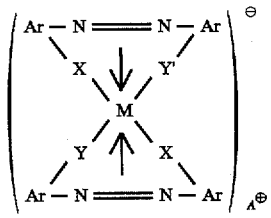

(1)

wherein M represents a central metal of coordination; Ar is an aryl group or an aryl group having a substituent selected from the group consisting of a nitro group, a halogen atom, a carboxyl group, an anilido group, an alkyl group having 1 to 18 carbon atoms and an alkoxyl group having 1 to 18 carbon atoms; X, X', Y and Y' each is —O—, —CO—, —NH— or —NR—, where R is an alkyl group having 1 to 4 carbon atoms; and $A^+$ represents a hydrogen ion, a sodium ion, a potassium ion, an ammonium ion or an aliphatic ammonium ion

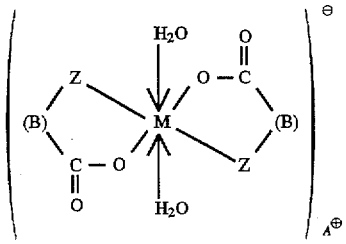

(2)

wherein M represents a central metal of coordination; B is;

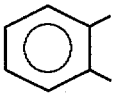

which may have an alkyl group as a substituent

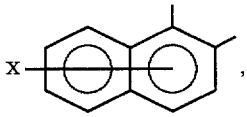

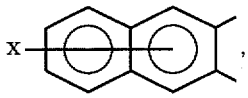

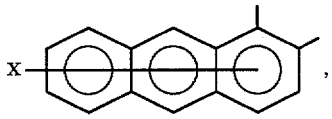

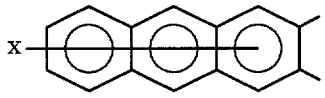

where X is a hydrogen atom, a halogen atom or a nitro group, or

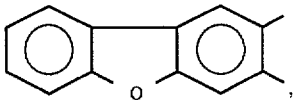

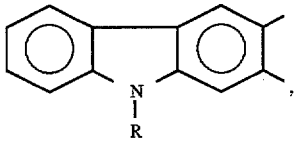

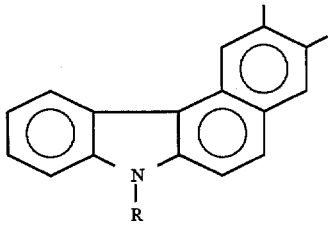

where R is a hydrogen atom, an alkyl group having 1 to 18 carbon atoms or an alkenyl group having 2 to 18 carbon atoms;

$A^+$ is a hydrogen ion, a sodium ion, a potassium ion, an ammonium ion or an aliphatic ammonium ion; and Z is —O— or

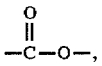

84. The process cartridge according to claim 55, wherein said magnetic toner particles contain an azo iron complex represented by the following Formula (3):

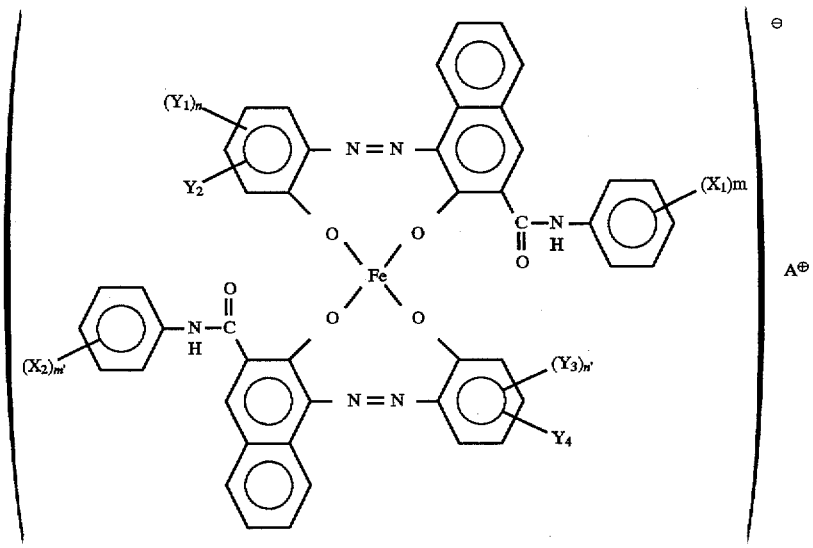

(3)

wherein $X_1$ and $X_2$ each represent a member selected from the group consisting of a hydrogen atom, a lower alkyl group, a lower alkoxyl group, a nitro group and a halogen atom, and m and m' each represent an integer of 1 to 3; $Y_1$ and $Y_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxyester group, a hydroxyl group, an alkoxyl group having 1 to 18 carbon atoms, an acetylamino group, a benzoyl group, an amino group and a halogen atom, and n and n' each represent an integer of 1 to 3; $Y_2$ and $Y_4$ each are a hydrogen atom or a nitro group; provided that the above $X_1$ and $X_2$, m and m', $Y_1$ and $Y_3$, n and n', and $Y_2$ and $Y_4$ may be the same or different; and $A^+$ represents an ion selected from the group consisting of an ammonium ion, an alkali metal ion, a hydrogen ion or a mixed ion of any of these.

85. The process cartridge according to claim 55, wherein said magnetic toner comprises said magnetic toner particles and an inorganic fine powder.

86. The process cartridge according to claim 85, wherein said inorganic fine powder is hydrophobic.

* * * * *

UNITED STATES PATENT AND TRADEMARK OFFICE

CERTIFICATE OF CORRECTION

PATENT NO. : 5,750,302

DATED : May 12, 1998

INVENTOR(S) : YOSHIHIRO OGAWA, ET AL.

It is certified that error appears in the above-identified patent and that said Letters Patent is hereby corrected as shown below:

IN THE DRAWINGS

Sheet 1 of 4, Figure 1, "DISSOLUSION" should read --DISSOLUTION--.

COLUMN 2

Line 60, "out put" should read --output--.

COLUMN 3

Line 26, "a more" should read --more--.

COLUMN 4

Line 58, "fee" should read --free--.

COLUMN 5

Line 19, "wherein;" should read --wherein:--;
Line 30, "of;" should read --of:--;
Line 43, "wherein;" should read --wherein:--; and
Line 58, "comprising;" should read --comprising:--.

COLUMN 6

Line 1, "wherein;" should read --wherein:--; and
Line 38, "the" should read --a--.

COLUMN 7

Line 4, "he" should read --the--; and
Line 53, "the" (second occurrence) should read --a--.

COLUMN 8

Line 26, "so" should read --such--.

UNITED STATES PATENT AND TRADEMARK OFFICE

CERTIFICATE OF CORRECTION

PATENT NO. : 5,750,302

DATED : May 12, 1998

INVENTOR(S) : YOSHIHIRO OGAWA, ET AL.

It is certified that error appears in the above-identified patent and that said Letters Patent is hereby corrected as shown below:

COLUMN 11

Line 30, "including;" should read --including:--.

COLUMN 14

Line 58, "formula." should read --formula:--.

COLUMN 15

Line 2, "components;" should read --components:--;
Line 18, "atoms)" should read --atoms).--; and
Line 37, "and may" should read --and--.

COLUMN 16

Line 33, "less causing" should read --causing less--; and
Line 67, "represents;" should read --represents--.

COLUMN 18

Line 14, "atoms);" should read --atoms).--.

COLUMN 25

Line 11, "(5);" should read --(5):--; and
Line 56, "those" should read --one--.

COLUMN 26

Line 29, "solvent" should read --solvent.--.

COLUMN 27

Line 26, "the" (first occurrence) should be deleted.

UNITED STATES PATENT AND TRADEMARK OFFICE

CERTIFICATE OF CORRECTION

PATENT NO. : 5,750,302

DATED : May 12, 1998

INVENTOR(S) : YOSHIHIRO OGAWA, ET AL.

It is certified that error appears in the above-identified patent and that said Letters Patent is hereby corrected as shown below:

COLUMN 39

Line 26, "little much" should read --little--; and
Line 27, "C: Very much toner scattering is seen." should read
--C: Very much toner scattering is seen.

Dot reproduceability: A pattern of individually independent dots was printed out to evaluate the reproducibility of each dot by microscopic observation.

A: Dots are faithfully reproduced.

B: A little disorder is seen in images.

C: Much disorder is seen in images, showing a poor reproducibility.

(5) Fixing performance:
Fixing performance was evaluated as a rate (%) of decrease in image density of fixed images before and after they were rubbed with soft thin paper under a load of 50 g/cm$^2$.

A: 0 to 10% (good)

B: 10 to 20% (passable)

C: More than 20% (failure)

(6)Anti-offset properties:
Sample images with an image area of about 5% were printed out, and anti-offset properties were evaluated according to the degree of stain on images after printing on 5,000 sheets.

A: Good (almost not occur).

B: Tolerable for practical use.

C: Not tolerable for practical use.

The results of evaluation on the above items (1) to (6) are shown in Table 4.--.

UNITED STATES PATENT AND TRADEMARK OFFICE

CERTIFICATE OF CORRECTION

PATENT NO. : 5,750,302

DATED : May 12, 1998

INVENTOR(S) : YOSHIHIRO OGAWA, ET AL.

It is certified that error appears in the above-identified patent and that said Letters Patent is hereby corrected as shown below:

COLUMN 40

Lines 1-27, should be deleted.

COLUMN 46

Line 47, "little much" should read --little--.

COLUMN 47

Line 10, "affects" should read --affecting--
and "formed." should read formed).--;
Line 20, "affects" should read --affecting--; and
Line 66, "10" should read --at 10--.

COLUMN 48

Line 58, "wherein;" should read --wherein:--.

COLUMN 50

Line 67, "ion" should read --ion;--.

COLUMN 51

Line 12, "is;" should read --is--; and
Line 34, "," should read --, or--.

COLUMN 52

Line 10, "," should read --, or--;
Line 31, "represents" should read --is--; and
Line 34, "represents" should read --is--.

UNITED STATES PATENT AND TRADEMARK OFFICE

CERTIFICATE OF CORRECTION

PATENT NO. : 5,750,302

DATED : May 12, 1998

INVENTOR(S) : YOSHIHIRO OGAWA, ET AL.

It is certified that error appears in the above-identified patent and that said Letters Patent is hereby corrected as shown below:

COLUMN 53

Line 22, "of;" should read --of:--; and
Line 35, "wherein;" should read --wherein:--.

COLUMN 54

Line 25, "100 %" should read --100%--.

COLUMN 55

Line 67, "ion" should read --ion;--.

COLUMN 56

Line 13, "represents;" should read --is--;
Line 34, "," should read --, or--; and
Line 52, "," should read --, or--.

COLUMN 57

Line 1, "represents" should read --is--;
Line 4, "represents" should read --is--;
Line 20, "$(x^1)_m$" should read --$(X_1)_m$--; and
Line 58, "comprising;" should read --comprising:--.

COLUMN 58

Line 1, "wherein;" should read --wherein:--.

COLUMN 59

Line 39, "at" should read --on--.

UNITED STATES PATENT AND TRADEMARK OFFICE

CERTIFICATE OF CORRECTION

PATENT NO. : 5,750,302

DATED : May 12, 1998

INVENTOR(S) : YOSHIHIRO OGAWA, ET AL.

It is certified that error appears in the above-identified patent and that said Letters Patent is hereby corrected as shown below:

COLUMN 60

Line 67, "ion" should read --ion;--.

COLUMN 61

Line 12, "is;" should read --is--; and
Line 34, "," should read --, or--.

COLUMN 62

Line 10, "," should read --, or--; and
Line 37, "-C-O-," should read -- -C-O-. --.

Signed and Sealed this

Ninth Day of March, 1999

*Attest:*

Q. TODD DICKINSON

*Attesting Officer*

*Acting Commissioner of Patents and Trademarks*